United States Patent [19]

Kato et al.

[11] Patent Number: 5,069,184

[45] Date of Patent: Dec. 3, 1991

[54] APPARATUS FOR CONTROL AND INTAKE AIR AMOUNT PREDICTION IN AN INTERNAL COMBUSTION ENGINE

[75] Inventors: Senji Kato, Toyota; Hidehiro Oba, Aichi, both of Japan

[73] Assignee: Toyoto Jidosha Kabushiki Kaisha, Japan

[21] Appl. No.: 620,212

[22] Filed: Nov. 30, 1990

Related U.S. Application Data

[62] Division of Ser. No. 362,770, Jun. 7, 1989, Pat. No. 5,003,950.

[30] Foreign Application Priority Data

Jun. 15, 1988 [JP] Japan ..... 63-147850
Jul. 30, 1988 [JP] Japan ..... 63-191153

[51] Int. Cl.[5] ..... F02D 41/02; F02P 5/15

[52] U.S. Cl. ..... 123/422; 123/417; 123/423; 123/488; 123/492; 123/493

[58] Field of Search ..... 123/492, 493, 422, 423, 123/478, 480, 486, 417, 494, 488; 73/117.3, 118.2; 364/431.07

[56] References Cited

U.S. PATENT DOCUMENTS

| | | | |
|---|---|---|---|
| 4,499,881 | 2/1985 | Takao | 123/492 |
| 4,712,529 | 12/1987 | Teresaka et al. | 123/492 |
| 4,785,785 | 11/1988 | Oba et al. | 123/488 |
| 4,870,937 | 10/1989 | Sanbuichi et al. | 123/488 |
| 4,892,072 | 1/1990 | Miwa et al. | 123/340 |
| 4,899,713 | 2/1990 | Nakamura | 123/478 |
| 4,919,100 | 4/1990 | Nakamura | 123/493 |
| 4,928,654 | 5/1990 | Hosaka | 123/480 |

FOREIGN PATENT DOCUMENTS

| | | |
|---|---|---|
| 59-28031 | 2/1984 | Japan . |
| 59-39948 | 3/1984 | Japan . |
| 59-196949 | 11/1984 | Japan . |
| 60-122237 | 6/1985 | Japan . |
| 62-157260 | 7/1987 | Japan . |
| 63-143348 | 6/1988 | Japan . |
| 62-208649 | 8/1988 | Japan . |
| 63-215848 | 9/1988 | Japan . |

*Primary Examiner*—Andrew M. Dolinar
*Attorney, Agent, or Firm*—Oliff & Berridge

[57] ABSTRACT

An apparatus to calculate the intake pipe pressure using the degree of throttle opening and the engine speed, to use this intake pipe pressure to calculate a current intake pipe pressure, and to determine a predicted value from this current intake pipe pressure and control fuel injection duration and/or spark timing. Becuase changes in the atmospheric pressure and changes in the air amount flowing through a bypass bypassing the throttle, etc., cause errors in the values predicted for the intake pipe pressure, there are irregularities in the exhaust emission. the atmospheric pressure and the intake pipe pressure, etc., detected by a pressure sensor are used to correct the predicted value, and prevent irregularities and the like in exhaust emissions.

8 Claims, 18 Drawing Sheets

APPARATUS FOR CONTROL AND INTAKE AIR AMOUNT PREDICTION IN AN INTERNAL COMBUSTION ENGINE

This is a division of application Ser. No. 362,770, filed June 7, 1989, now U.S. Pat. No. 5,003,950.

BACKGROUND OF THE INVENTION

1. Field of the Invention

The present invention relates to an apparatus for control of an internal combustion engine and to a device for predicting the amount of intake air. More particularly, the present invention is concerned with an apparatus for control of the fuel injection duration and the spark timing on the basis of the amount of throttle opening and the engine speed, and with an apparatus for predicting the intake air amount or a physical amount corresponding to the intake air amount around closing time of an intake valve used to control the fuel injection duration and the spark timing.

2. Description of the Related Art

In the field of internal combustion engines, there are known internal combustion engines where the fuel injection duration is controlled on the basis of the air amount passing the side upstream of the throttle valve or absolute pressure of the intake, or the absolute pressure of the intake pipe (hereinafter, referred to as the "intake pressure"), and the engine speed. The air amount and physical amount of the intake pipe both correspond to the amount of intake air taken into a combustion chamber of the engine. Thus, in an internal combustion engine, there are steps of calculating the intake air amount per rotation of the engine from these amounts and the engine speed, determining the basic fuel injection time from the intake air amount per engine rotation and on the basis of the air-fuel ratio, and determining the fuel injection duration by correcting the basic fuel injection duration in accordance with factors such as the intake air temperature, cooling water temperature, and so forth, and so controlling the amount of fuel injection by opening the fuel injection valve for a period of time equal to the thus determined fuel injection duration.

In this known system, when the fuel injection duration is controlled on the basis of the intake air pressure and the engine speed, the intake air pressure is, in principle, approximately proportional to the amount of intake air taken into the engine per cycle. A diaphragm type pressure sensor is attached to the intake pipe on the side downstream from the throttle, and the output from this pressure sensor is processed by a filter having a time constant of 3 to 5 msec for eliminating the pulsation component of the intake pressure caused by the operation of the engine. The basic fuel injection duration is computed from the thus detected intake pressure and the engine speed which is sensed by a suitable engine speed sensor. This known system has a drawback in that the detected change in the intake pressure has a certain time lag behind the actual change in the intake pressure during acceleration and other periods of transient operation of the engine. This delay is because of a delay in the response of the diaphragm of the pressure sensor, and due to a delay of response attributable to the time constant of the filter. Because of this, when the engine is being accelerated quickly by fast opening of the throttle valve accompanied by a drastic rise in the intake air pressure, the detected intake pressure rises rather slowly and so the basic fuel injection duration is computed on the basis of an intake pressure which is lower than the actual intake pressure. As a consequence, the air-fuel mixture supplied to the engine becomes too lean, resulting in the response of the engine to the acceleration demand being impaired, and in an increase in noxious exhaust emissions. Conversely, when the engine is being decelerated with fast closing of the throttle valve accompanied by a rapid drop in the intake air pressure, the basic fuel injection duration is computed on the basis of an intake pressure which is higher than the actual intake pressure. As a consequence, the air-fuel mixture supplied to the engine becomes too rich, resulting in the driveability of the engine being impaired, and in an increase in noxious exhaust emissions. In order to prevent these problems attributable to the generation of a mixture that is either too rich or too lean, various corrections have been performed, for example, using acceleration increments or deceleration decrements for the fuel supply. Nevertheless, because of the presence of the abovementioned time lag or delay in the detection of the intake pressure during transition operation of the engine, it has been impossible to control the air-fuel ratio of the mixture to the objective air-fuel ratio, over the entire range of engine operation.

Moreover, when the fuel injection duration is controlled on the basis of the air amount and the engine speed, the intake air amount is directly detected by a flow sensor such as a Kermin vortex type of air flow meter and an air flow meter mounted on the side upstream of the throttle valve. However, since the flow sensor is mounted on the side upstream of the throttle valve, a time lag occurs between the changes in the actual intake air amount and the corresponding changes in the flow sensor output. The result is the same problem as is described above.

Because of this, since the amount of opening of the throttle valve is a physical quantity having no time lag with respect to the actual intake air amount, fuel injection has been controlled on the basis of this amount of opening of the throttle valve, and the engine speed.

Japanese Patent Application Laid-Open Nos. 28031/1984, 96949/1984 and 122237/1985 propose that the basic fuel injection duration be determined using the amount of opening of the throttle valve of the engine, as a parameter that has no inherent time lag with respect to changes in the engine pressure. Japanese Patent Application Laid-Open No. 39948/1984 proposes that the basic fuel injection duration be determined by calculating the intake pipe pressure from the amount of opening of the throttle valve of the engine and the engine speed, and then using the intake pipe pressure so calculated, and the engine speed to calculate the basic fuel injection duration. The above described amount of opening of the throttle valve is detected by a voltage proportional to the amount of opening of the throttle valve and as output from a throttle valve opening amount sensor comprising a variable resistor comprising a contact fixed to the rotating shaft of the throttle, and in which one terminal is connected to a battery and the other to ground. However, throttle valves are normally located upstream from the engine combustion chamber(s) and as a consequence, a time lag is inevitably caused because a certain period of time is required for the air having passed the throttle valve, to reach the combustion chamber of the engine. Moreover, the phase of operation of the throttle valve is ahead of the phase of changes.in the actual suction of the mixture by the engine because of the volume of space in the intake pipe between the throttle valve and the intake valve of the engine. As a consequence, the phase of the intake pressure P(TA, NE) determined in accordance with the degree of throttle opening and the engine speed, is ahead of the phase of the actual intake pressure P, as shown in FIG. 24. Moreover, as shown in FIG. 25, the basic fuel injection duration TP (TA, NE) determined by the degree of throttle opening is greater than the fuel injection duration actually required because the phase of the change in the degree of throttle opening is ahead of the phase of the change in the actual intake air amount. Therefore, when the fuel injection duration is controlled on the basis of the degree of throttle opening and the engine speed, the actual fuel injection duration exceeds the that demanded during acceleration and the mixture is made excessively rich as a consequence. Conversely, during deceleration, the actual fuel injection duration becomes smaller than that demanded, and the mixture is made excessively lean as a consequence. When acceleration incrementation is performed for the fuel supply, the fuel supply rate is increased as shown by the hatched portion in FIG. 25, but the undesirable effects caused by the phase advance described above cannot be eliminated.

Moreover, the same problem as described above occurs because sparking is controlled on the basis of the degree of throttle opening and the engine speed.

Furthermore, the point at which the amount of air supplied to the engine combustion chamber is determined is the point at which intake is complete, or rather, the point at which the intake valve closes. Therefore, in order to control the values for the control quantities such as the fuel injection duration and spark timing, to those required by the engine, control of these control quantities can be performed using the values detected in the proximity of the intake valve opening valve at the point when the intake air amount taken in to the engine combustion chamber is determined, this is to say, when the intake valve closes. However, when fuel injection duration control is performed, because a certain amount of time is necessary to calculate the control quantities, a certain amount of time is necessary for the fuel injected from the fuel injection valve to travel to the combustion chamber after the intake air amount supplied to the combustion chamber is decided. Because of these delays, it no longer becomes possible to calculate and control the control quantities to the values required by the engine.

Therefore, in conventional apparatus such as Japanese Patent Application Laid-Open No. 157260/1987, the amount of change per unit time $(Q_n-Q_{n-1})\ \Delta T$ of the degree of throttle opening is determined and this amount of change is multiplied by the time difference $\Delta T$ up till the point where the prediction is made, the degree of throttle opening is then calculated for this point and the results used as the basis for predicting the engine control quantities.

Nevertheless, as described above, the phase of operation of the throttle valve is ahead of the phase of changes in the actual suction of the mixture by the engine and, as a consequence, the phase of the control quantities determined by the degree of throttle opening and the engine speed is also ahead of the phase of changes in the actual suction of the mixture by the engine. Accordingly, even if the control quantities are predicted as in the conventional apparatus, by the amount of change in the degree of throttle opening, the fuel injection duration becomes greater than the rate demanded during acceleration and the air-fuel ratio becomes too rich, and the fuel injection duration becomes less than the rate demanded during deceleration and the air-fuel ratio becomes too lean.

Because of this problem, the applicant of the present invention has already proposed a method of controlling the fuel injection duration (Japanese Patent Application Laid-Open No. 51056/1987) using the engine speed and the degree of throttle opening with no response lag with respect to the actual intake pipe pressure, and using this as a basis to calculate the intake pipe pressure PMTA for the constant state and for performing time lag correction in transition states so that the current air intake pipe pressure PMCRT is calculated without phase lead or lag. This calculated air intake pressure is used as the basis for predicting the intake pipe pressure at the point where the air amount taken into the engine is determined, and then using this predicted value and the engine speed as the basis for controlling the fuel injection duration.

However, in the above stated proposed by the applicant of this invention, the intake air pressure is predicted by calculation only, for the point where the air amount taken into the engine is determined, and without taking into account the actual intake pipe pressure. Because of this, the accuracy of the predicted value is adversely influenced by discrepancies in the intake pipe pressure in the constant state, to produce the problem of irregular emission control.

Furthermore, if the atmospheric pressure changes, the air density changes so that the amount of air supplied to the combustion chamber changes even if the degree of throttle opening is maintained constant. This creates a discrepancy between the value required by the engine and the calculated value for the fuel injection duration and the resultant problem of irregular emission. This same problem also occurs in engines fitted with superchargers. In order to eliminate this problem, the intake air pressure can be measured and successive correction performed for the current intake pipe pressure PMCRT calculated on the basis of this measured value. However, the greater the discrepancy due to the atmospheric pressure, the higher the load and the accuracy of the values measured for transition stages deteriorates. This is illustrated by FIG. 26, for the situation where there is full acceleration at full throttle.

In the constant stage, intake pipe pressure PMTA discrepancy amount a, i.e., the true discrepancy amount of the atmospheric pressure becomes greater than the discrepancy amount b, i.e., the correction amount according to the above sequential corrections, so that the intake pipe pressure PMTA corrected using discrepancy amount b becomes smaller than the true value. As a consequence, the PMFWD value estimated using the intake pipe pressure PMTA after correction becomes smaller than the true estimated value, and the mixture is made lean.

Moreover, in engines fitted with superchargers, there is a blower provided to perform supercharging on the side upstream of the throttle. The pressure upstream of the blower therefore varies greatly in accordance with the conditions of operation and the intake pipe pressure PMTA and PMCRT vary as shown in FIG. 27. The same discrepancy shown in FIG. 26 is present even if the engine is fitted with a supercharger.

Furthermore, if the air amount flowing through the throttle is controlled by a bypass during idling to control the idling rotation speed, then when there are changes in the amount of air bypassing the throttle, the correspondence between the degree of throttle opening and the intake pipe pressure will deteriorate to cause a discrepancy between the estimated value and the actual value for the intake air pressure at the time of prediction, to result in the problem of not being able to control the control quantities to the values required by the engine.

SUMMARY OF THE INVENTION

Accordingly, an object of the present invention is to provide an internal combustion engine control device which can solve the problems described above by determining the intake pipe pressure, etc. with good precision by considering the actual intake pipe pressure, etc., and which can control the fuel injection duration.

A further object of this invention is to provide an internal combustion engine control device which can perform atmospheric pressure correction and supercharger pressure correction to accurately determine the intake pipe pressure, etc., and control the fuel injection duration.

A still further object of this invention is to provide an internal combustion engine intake air amount prediction device that can accurately predict a physical amount corresponding to the intake air amount or the intake air amount itself at a predetermined prediction time.

To this end, according to the first aspect of the present invention, there is provided a configuration comprising: a throttle opening degree detection means for detecting the degree of throttle opening, an engine speed detection means for detecting the engine speed, a measurement means for measuring a physical amount corresponding to the intake air amount or the amount of air taken into the engine combustion chamber itself, and physical amounts other than those related to throttle control, a prediction means using the degree of throttle opening and the engine speed as the basis to calculate the current value for the physical amount corresponding to the intake air amount or the intake air amount taken into the engine combustion chamber itself and for predicting the value for a prediction time a certain time into the future from the said current value, a correction means using values measured by said measurement means to correct the predicted value of said prediction means, and a control means to control the fuel injection duration and/or spark time on the basis of the corrected prediction value and engine speed.

According to this invention, the degree of throttle opening and the engine speed are used as the basis for calculating the current amount of intake air taken into the engine combustion chamber, or the physical amount corresponding to this intake air amount. This calculated current amount of intake air or the physical amount is then used as the basis for calculating the predicted value for the amount of intake air to be taken into the engine combustion chamber (or the physical amount corresponding to this intake air amount) a certain time from the point at which the calculation was made. Moreover, the amount of intake air taken into the engine combustion chamber (or the physical amount corresponding to this intake air amount), and the physical quantities other than the degree of throttle opening are detected and the predicted value described above is corrected by the detected intake air amount and the physical quantities, and the corrected predicted value and the engine speed are used as the basis for controlling the fuel injection duration. In this way, because the predicted value is corrected by the detected intake air amount and the physical quantities, there is correction to the true value even if there is an error in the value calculated for the predicted value, and hence irregular emissions and the like can be prevented. Furthermore, the physical quantities described above can be the air amount passing on the upstream side of the throttle valve, or the intake pipe pressure on the downstream side of the throttle valve.

According to the invention as described above, the calculated predicted value is corrected by the detected value and the error with respect to the true value of the predicted value is minimized so that irregular exhaust emission can be prevented.

Moreover, according to a second aspect of this invention, there is provided a configuration comprising: a throttle opening degree detection means for detecting the degree of throttle opening, an engine speed detection means for detecting the engine speed, a measurement means for measuring the atmospheric pressure or the pressure on the upstream side of the throttle, a prediction means for calculating the current value of the amount of intake air taken into the engine combustion chamber or a physical amount corresponding to this intake air amount and for predicting the value at a prediction time a certain time into the future from the said current value, a correction means using values measured by said measurement means to correct the predicted value of said prediction means, and a control means to control the fuel injection duration and/or spark time on the basis of the corrected prediction value and engine speed.

According to this invention, the degree of throttle opening and the engine speed are used as the basis for calculating the current amount of intake air taken into the engine combustion chamber, or the physical amount corresponding to this intake air amount. This calculated current amount of intake air or the physical amount is then used as the basis for calculating the predicted value for the amount of intake air to be taken into the engine combustion chamber (or the physical amount corresponding to this intake air amount) a certain time from the point at which the calculation was made. Moreover, the atmospheric pressure or the pressure on the upstream side of the throttle is detected and the predicted value described above is corrected in accordance with the detected atmospheric pressure in the case of a naturally aspirating engine, or by the pressure on the side upstream of the throttle in the case of an engine fitted with a supercharger (with the correction being performed in accordance with the atmospheric pressure when the supercharger is not operating, and by the pressure on the side upstream of the throttle when the supercharger is operating), and the corrected predicted value and the engine speed are used as the basis for control of the fuel injection duration. In this way, because the predicted value is corrected in accordance with the atmospheric pressure and the pressure on the side upstream of the throttle, there is correction to the true value even if there are changes in the atmospheric pressure or changes due to the operation of a supercharger, and hence irregular emissions and the like can be prevented.

According to the invention as described above, the calculated predicted value is corrected in accordance with the values detected for the atmospheric pressure and the pressure on the side upstream of the throttle, and the error with respect to the true value of the predicted value minimized so that irregular exhaust emission can be prevented.

Moreover, according to a third aspect of this invention and as shown in FIG. 1(A), there is provided a configuration that comprises: a throttle opening degree detection means A for detecting the degree of throttle opening, an engine speed detection means B for detecting the engine speed, a measurement means C for measuring a physical amount corresponding to the intake air amount or the amount of air taken into the engine combustion chamber itself, a first calculation means D for calculating the current value for the amount of intake air taken into the engine combustion chamber or a physical amount corresponding to this intake air amount, a prediction means E for predicting the value at a prediction time a certain time into the future from the current value, and a second calculation means F for calculating the value corresponding to the amount of intake air or a physical amount corresponding to this intake air amount, for the prediction time and on the basis of the value measured by the first measurement means C and the difference between the current value and the value predicted by prediction means E, or the difference between the current value and the value measured by the measurement means, and the value Predicted by the prediction means.

According to this invention, the degree of throttle opening and the engine speed are detected by the throttle opening degree detection means A and the engine speed detection means B. Moreover, the measurement means C measures the amount of intake air taken into the engine combustion chamber, or the physical amount corresponding to this intake air amount. This intake air amount can be detected by flow sensors and the physical quantity corresponding to the intake air amount can be the intake pipe pressure detected by a pressure sensor. On the basis of the detected by the first calculation means D, the first calculation means D calculates the current value for the amount of intake air taken into the engine combustion the amount of intake air taken into the engine combustion chamber or a physical amount corresponding to this intake air amount, and the prediction means E predicts the value at a prediction time a certain time into the future from the said current value.

Furthermore, if there is air that bypasses the throttle and is taken into the engine, the value predicted by the prediction means E will have a discrepancy with the actual value at the time of measurement. When the prediction time is not a long time ahead of the time at which the prediction is made, the amount of intake air or a physical amount corresponding to this intake air amount can be considered to change at the same rate for both the prediction time and the time at which the prediction is made and so the difference between the predicted value and the actual value is equal to the difference between the current value described above, and the value measured for the current time. Here, the second measurement means F attempts to calculate the actual value for the prediction time on the basis of the measured value and the difference between the current value and the predicted value, or the predicted value and the difference between the current value and the measured value. The intake pipe pressure is used as the physical quantity corresponding to the intake air pressure, and in the case where the currently measured value is $PM_0$, the current value calculated by the calculation means D is PMSM1, the predicted value calculated by prediction means E is PMSM2, and the actual value for the prediction time is PMFWD, then referring to FIG. 1 (B), the actual value PMFWD can be expressed as either $PM_0+\Delta P$ or as $PMSM2-(PMSM1-PM_0)$.

According to the invention described above, the value corresponding to the intake air amount or the intake air amount at the prediction time is calculated in consideration of the bypass air amount that bypasses the throttle and is taken in. Because of this, it is possible to accurately predict the value corresponding to the intake air amount or the intake air amount at the predition time even in the case where there is an amount of bypass air.

BRIEF DESCRIPTION OF THE DRAWINGS

FIG. 1 (B) is a graph indicating an example of a calculation of the calculation means shown in FIG. 1.

DESCRIPTION OF THE PREFERRED EMBODIMENTS

Reference will now be made in detail to presently preferred embodiments of the invention. The embodiments of the present invention are applied to a device for controlling an amount of fuel injection on the basis of the degree of throttle opening and the engine speed.

Figure 1A:
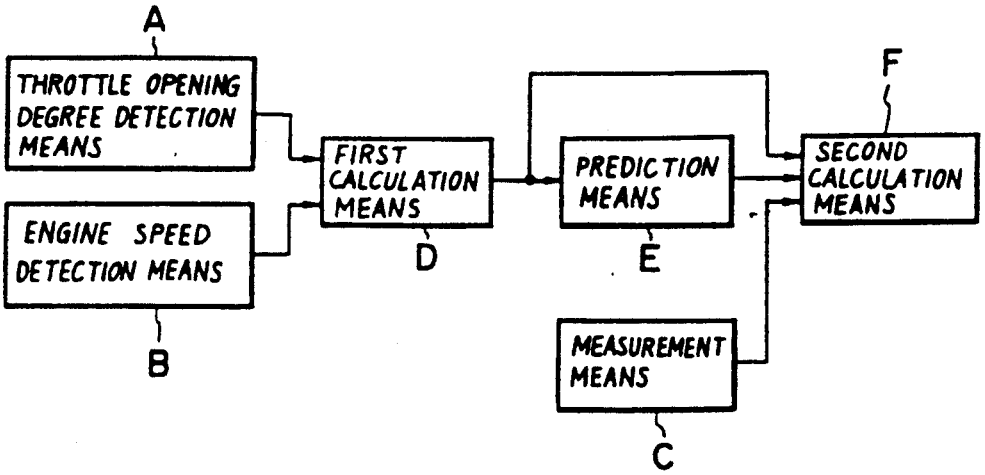
FIG. 1 (A) is a block diagram showing the relationship between control elements used in the present invention.
Figure 1B:
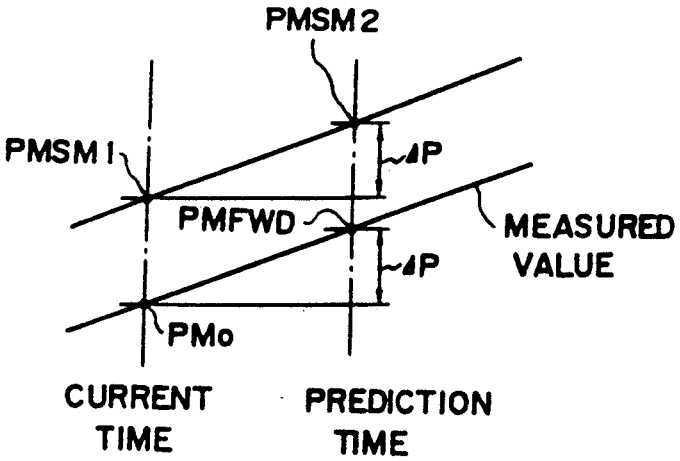
Figure 2:
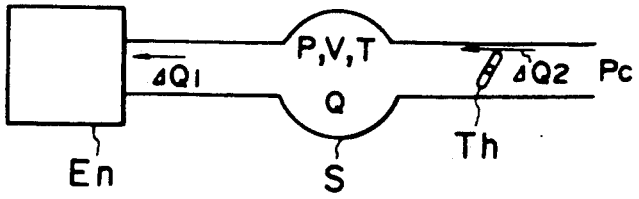
FIG. 2 is a schematic diagram indicating the principle for determining the fuel injection duration from the degree of throttle opening and the engine speed.

The first part of the description concerns the principle for calculation of the intake pipe pressure (physical quantity corresponding to the intake air pressure) on the basis of the degree of throttle opening and the engine speed. FIG. 2 shows the part of the intake system from the throttle Th through the surge tank S to the engine $E_n$, where the air pressure (intake pipe absolute pressure) is P (mmHgabs), the volume of the intake system is V (1), the mass of the air in the intake system Q (1 g), the absolute temperature of the air in the intake system is T (° K), atmospheric pressure is Pc (mmHgabs), and where the mass of air taken from the intake system into the combustion chamber of the engine $E_n$ per unit time is $\Delta Q_1$ (g/sec), the mass of air passing the throttle and taken into the intake system per unit time is $\Delta Q_2$ (g/sec). Then, if the change in the mass of intake system air in the small time interval $\Delta t$ is $(\Delta Q_2-\Delta Q_1)\cdot\Delta t$, and the change in the pressure of the air within the intake system at this time is $\Delta P$, the pressure of the air in the intake system can be expressed by applying the Boyle-Charles' Law as formula (1).

$$(P+\Delta P)V=\{Q+(\Delta Q_2-\Delta Q_1)\cdot\Delta t\}\,RT \quad \ldots (1)$$

where, R is a gaseous constant.

Since $PV=Q\cdot P\cdot T$, the above formula (1) can be transformed to give the following formula (2).

$$\frac{\Delta P}{\Delta t} = (\Delta Q_2 - \Delta Q_1)\frac{RT}{V} \quad (2)$$

Here, if the flow coefficient is $\Psi$, and the area of the opening of the throttle (throttle opening angle) is A, then the air mass $\Delta Q_2$ passing the throttle per unit time can be expressed by the following formula (3), and if the stroke volume is $V_s$, the engine speed is NE (rpm) and the intake efficiency is $\eta$, then the air mass $\Delta Q_1$ taken into the engine combustion chamber per unit time can be expressed by the following formula (4).

$$\Delta Q_2 = \Psi\cdot A\sqrt{Pc-P} \quad (3)$$

$$\Delta Q_1 = \frac{1}{2}\,\frac{V_s}{V}\cdot\frac{NE}{60}\cdot\eta\cdot P\cdot\frac{1}{PT} \quad (4)$$

Substituting the above formulae (3) and (4) into formula (2) gives the following formula (5).

$$\frac{\Delta P}{\Delta t} = \frac{RT}{V}\Psi\cdot A\sqrt{Pc-P} - \frac{1}{2}\,\frac{V_s}{V}\cdot\frac{NE}{60}\cdot\eta\cdot P \quad (5)$$

Where, if $\Delta t\rightarrow 0$, then $$\frac{dP}{dt} = \frac{RT}{V}\Psi\cdot A\sqrt{Pc-P}\cdot\frac{1}{2}\,\frac{V_s}{V}\cdot\frac{NE}{60}\cdot\eta\cdot P \quad (6)$$

Now, in terms of the response in the region of the pressure $P_0$ ($\neq 0$), if the pressure changes from $P_0$ to $P_0+P$ and this is substituted into P in the above formula (6), then the following formula (7) will be obtained.

$$\frac{dP}{dt} = \frac{RT}{V}\Psi\cdot A\sqrt{Pc-P_0-P} - \frac{1}{2}\,\frac{V_s}{V}\cdot\frac{NE}{60}\cdot\eta\cdot(P_0+P) \quad (7)$$

where, $$\sqrt{Pc-P_0-P} = \sqrt{Pc-P_0}\left(1-\frac{P}{Pc-P_0-P}\right)^{\frac{1}{2}} \cong \sqrt{Pc-P_0}\left(1\cdot\frac{1}{2}\,\frac{P}{Pc-P_0}\right) = \sqrt{Pc-P_0} - \frac{1}{2}\,\frac{P}{\sqrt{Pc-P_0}} \quad (8)$$

Therefore, the above formula (7) becomes the following formula (9).

$$\frac{dP}{dt} = \frac{RT}{V}\Psi\cdot A\sqrt{Pc-P_0} - \frac{1}{2}\,\frac{RT}{V}\Psi\cdot A\frac{P}{\sqrt{Pc-P_0}} - \frac{1}{2}\,\frac{V_s}{V}\cdot\frac{NE}{60}\cdot\eta\cdot(P_0+P)$$

$$= -\frac{1}{2}\left(\frac{V_0}{V}\cdot\frac{NE}{60}\cdot\eta + \frac{RT\Psi A}{V\sqrt{Pc-P_o}}\right)P + \frac{RT}{V}\Psi A\sqrt{Pc-P_0} - \frac{1}{2}\,\frac{V_s}{V}\cdot\frac{NE}{60}\cdot\eta P_0 \quad (9)$$

where, if

-continued $$a = \frac{1}{2}\left(\frac{V_s}{V}\cdot\frac{NE}{60}\cdot\eta + \frac{RT\Psi A}{V\sqrt{Pc - P_0}}\right) \quad (10)$$

$$b = \frac{RT}{V}\Psi A\sqrt{Pc - P_0} - \frac{1}{2}\ \frac{V_s}{V}\cdot\frac{NE}{60}\cdot\eta P_0 \quad (11)$$

Then the above formula (9) can be rewritten as follows.

$$\frac{dP}{dt} = -aP + b \quad (12)$$

Transforming the above formula (12) into formula (13) as follows and integrating both sides to give the integral constant C, gives the following formula (14).

$$\frac{dP}{-aP + b} = dt \quad (13)$$

$$-\frac{1}{a}\ln(-aP + b) = t + C \quad (14)$$

Here, when t=0, the initial value for P is $P_0$ and so from formula (14), the integral constant C becomes as follows.

$$C = -\frac{1}{a}\ln(-aP_0 + b) \quad (15)$$

Determining P from the above formulae (14) and (15) gives the following.

$$P = \frac{b}{a}\cdot\left(\frac{b}{a}\cdot P_0\right)\cdot e^{-at} \quad (16)$$

where, e is the base of a natural logarithm.

Accordingly, the area A of the opening of the throttle, or rather, the degree of opening TA, the engine speed NE and the elapsed time t since the time when the amount of throttle opening began to change are measured and input to formula (16) above, it becomes possible to determine the current intake pipe pressure P. It then becomes possible to use the value for P thus determined to calculate the predicted value (predicted intake pipe pressure) for the intake pipe pressure at the time when the intake valve closes at a certain time in the future.

Figure 3:
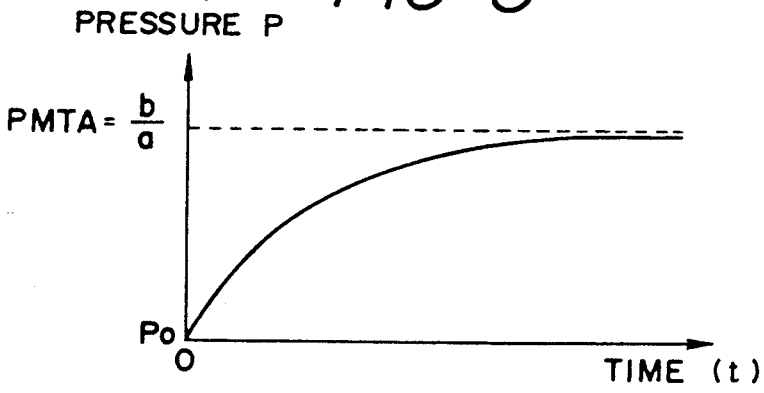
FIG. 3 is a graph indicating the changes with respect to time, of the actual intake air pressure in the intake pipe.

FIG. 3 is a graph showing the current intake pipe pressure P of formula (16) above. When t=0, P=$P_0$ and when t→∞ (constant status), the output becomes P=b/a (intake pipe pressure PMTA for the constant status), which is the primary lag factor. Accordingly, by calculating the intake pipe pressure PMTA on the basis of the degree of throttle opening TA and the engine speed NE and for the constant state, the intake pipe pressure PMTA for the constant state can be represented and processed as the primary lag factor expressed by the transmission coefficient G(s) of the following formula (17), so as to calculate the current pipe pressure.

$$G(s) = \frac{1}{Ts + 1} \quad (17)$$

where, s represents the operator of a Laplace transformation, and T is a time constant.

This is to say that by calculating the intake pipe pressure in the constant state, on the basis of the degree of throttle opening and the engine speed, and by processing the intake pipe pressure for the constant state as the primary lag factor, the intake pipe pressure (current intake pipe pressure) can be calculated using the said elapsed time as the variable.

Moreover, calculating the intake pipe pressure is the constant state and for a fixed duration, on the basis of the degree of throttle opening and the engine speed;

calculating the time constant relating to the changes in the intake pipe pressure during transition operation and calculating the coefficients relating to the weighting for said fixed duration, and calculating the current average weighting value by using the previous average weighting value obtained by adding weighting to a previously calculated average weighting value, and the coefficients relating to the said weighting and the intake pipe pressure for the constant state, are all possible using this current average weighting value as the current intake pipe pressure.

Figure 4:
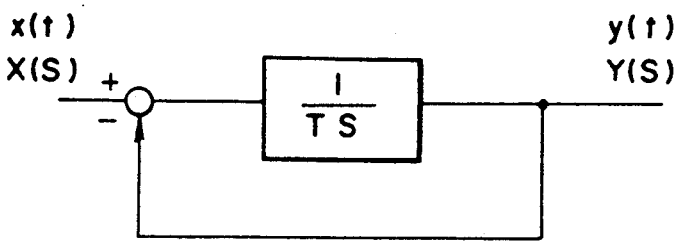
FIG. 4 is a block diagram indicating the input and output of the primary delay factors.

The following is an explanation of the principle used above. FIG. 4 expresses the primary lag factor in block form, with input x(t), output y(t) and time constant T. The input-output relationships in FIG. 4 to be expressed in the formulae below.

$$\frac{1}{T}\int_0^t \{x(t) - y(t)\}dt = y(t) \quad (19)$$

$$\frac{1}{T}\int_0^{t_1} \{x(t) - y(t)\}dt + \frac{1}{T}\int_{t_1}^t \{x(t) - y(t)\}dt = y(t) \quad (20)$$

$$y(t_1) + \frac{1}{T}\int_{t_1}^t \{x(t) - y(t)\}dt = y(t) \quad (20')$$

Where, expressing $t_2$ as the current calculated timing and $t_1$ as the past calculated timing gives the following formula (21) (where $\Delta t = t_2 - t_1 < \epsilon$).

$$\frac{1}{T}(t_2 - t_1)\cdot\{x(t_1) - y(t_1)\} + y(t_1) \simeq y(t_2) \quad (21)$$

The reason for this is that if $t = t_2$ in formula (20'), then $$y(t_2) = y(t_1) + \frac{1}{T}\int_{t_1}^{t_2} \{x(t) - y(t)\}dt \quad (21')$$

and if $$t_2 - t_1 = \Delta t < \epsilon$$

then $$x(t_1) \simeq x(t_2),\ y(t_1) \simeq y(t_2)$$

$$\int_{t_1}^{t_2} x(t)dt = \Delta t\cdot x(t_2)$$

-continued $$\int_{t_1}^{t_2} y(t)dt = \Delta t \cdot y(t_1)$$

Accordingly, in the above formula (21')

$$y(t_2 \approx y(t_1) + \frac{1}{T}\Delta t \cdot x(t_2) - \Delta t \cdot y(t_1)$$
$$= y(t_1) + \frac{\Delta t}{t}\{x(t_2) - y(t_1)\}$$

In the above formula (21)',$x(t_2)$ is the intake air pressure PMTA, $y(t_2)$ is the current intake air pressure $PMSM_i$, $y(t_1)$ is the past intake air pressure $PMSM_{i-1}$, and $t_2-t_1$ ($=\Delta t$) is the duration for calculation, then $$\frac{\Delta t}{t}(PMTA - PMSM_{i-1}) + PMSM_{i-1} = PMSM_i \quad (22)$$

and when $t/\Delta t=n$, the following formula (23) can be obtained.

$$PMSM_i = \frac{(n-1)\cdot PMSM_{i-1} + PMTA}{n} \quad (23)$$

This is to say that by using the above formula (23) to determine the weighted average when the weighting for the past intake air pressure $PMSM_{i-1}$ is $(n-1)$ and the weighting for the intake air-pressure PMTA in the constant state is 1, it is possible to calculate the current air intake pressure $PMSM_i$. Moreover, the coefficient n relating to the weighting is determined by the calculation duration $\Delta t$ and the time constant T. Furthermore, the valve for the weighted average can be determined by a digital filter processing.

Accordingly, if the degree of throttle opening and the engine speed are used as the basis for calculating the intake air pressure PMTA in the constant status for the required duration $\Delta t$, the coefficient n relating to the weighting for the required duration $\Delta t$ and the time constant T relating to changes in the intake air pressure for the transition stage, and if the value for the weighted average $PMSM_1$ is calculated using the value for the weighted average $PMSM_{i-1}$ calculated in the past by increasing the weighting for the value for the weighted average $PMSM_{i-1}$ calculated in the past, the intake air pressure PMTA in the constant status, and the coefficient n relating to the weighting, then the current intake pipe pressure, can be determined.

Furthermore, as can be understood from formulae (10) and (16), the time $T=1/a$ becomes smaller for the greater the engine speed NE, and smaller for the greater the degree of throttle opening.

In this way, the time constant is expressed as a funΔtion with the degree of throttle opening TA and the engine speed NE as the variables. Accordingly, if the calculation duration $\Delta t$ is made constant, then the coefficient n relating to the weighting can be expressed with the degree of throttle opening TA and the change in the engine speed NE as the variables. Moreover, the degree of throttle opening TA and the change in the engine speed NE can readily determine the intake pipe pressure PMTA for the constant status and so substituting the degree of throttle opening TA and the engine speed NE allows the coefficient n relating to the weighting to be determined in accordance with the degree of throttle opening TA and the engine speed NE for the normal status.

In formula (23), assuming that the degree of throttle opening TA and the engine speed NE do not change, then the intake pipe pressure PMTA is constant for the duration between the calculation of the value for the weighted average and the determination of the intake air amount. In other words, the intake pipe pressure PMTA is constant for the constant status for the required duration from the time of calculation of the value for the weighted average. Accordingly, repeated calculation of the value for the weighted average using formula (23) makes it possible to predict the actual intake air pressure for when the intake air amount is determined. In this case, differences between the past intake pipe pressure $PMSM_{i-1}$ will result in differences with the predicted value and so determining the number of times of calculation by calcuating the calculation duration $\Delta t$ from the point at which the intake pipe pressure is calculated for the constant status until the time at which the air amount input to the engine is determined, detecting the intake pipe pressure by a pressure sensor and repeatedly calculating the weighted average using formula (23) for only the number of times of calculation and with the detected intake pipe pressure as the initial value, makes it possible to predict the value for the weighted average at the point where the amount of air taken into the engine is determined, or rather, the intake pipe pressure at the point where the amount of air taken into the engine is determined.

In the above, it is assumed that there is no change in the degree of throttle opening and the engine speed for the duration between the calculation of the value for the weighted average and the determination of the intake air amount. In operation the degree of throttle opening and the engine speed can change. Thus, if the integral of the values/value for the degree of throttle opening and/or the engine speed are/is calculated during the duration of fuel injection and used to predict the degree of throttle opening and/or the engine speed, if the air pipe pressure for the constant state when the air intake amount has been determined is calculated, if the weighted average as described above is calculated and the actual intake pipe pressure calculated, then the accuracy of the value predicted for the actual intake pipe pressure during changes in the degree of throttle opening and/or the engine speed is further improved.

Furthermore, the intake pipe pressure is roughly proportional to the amount of intake air taken in per cycle and so the degree of throttle opening and/or the engine speed can be used as the basis to calculate the amount of intake air.

Figure 5:
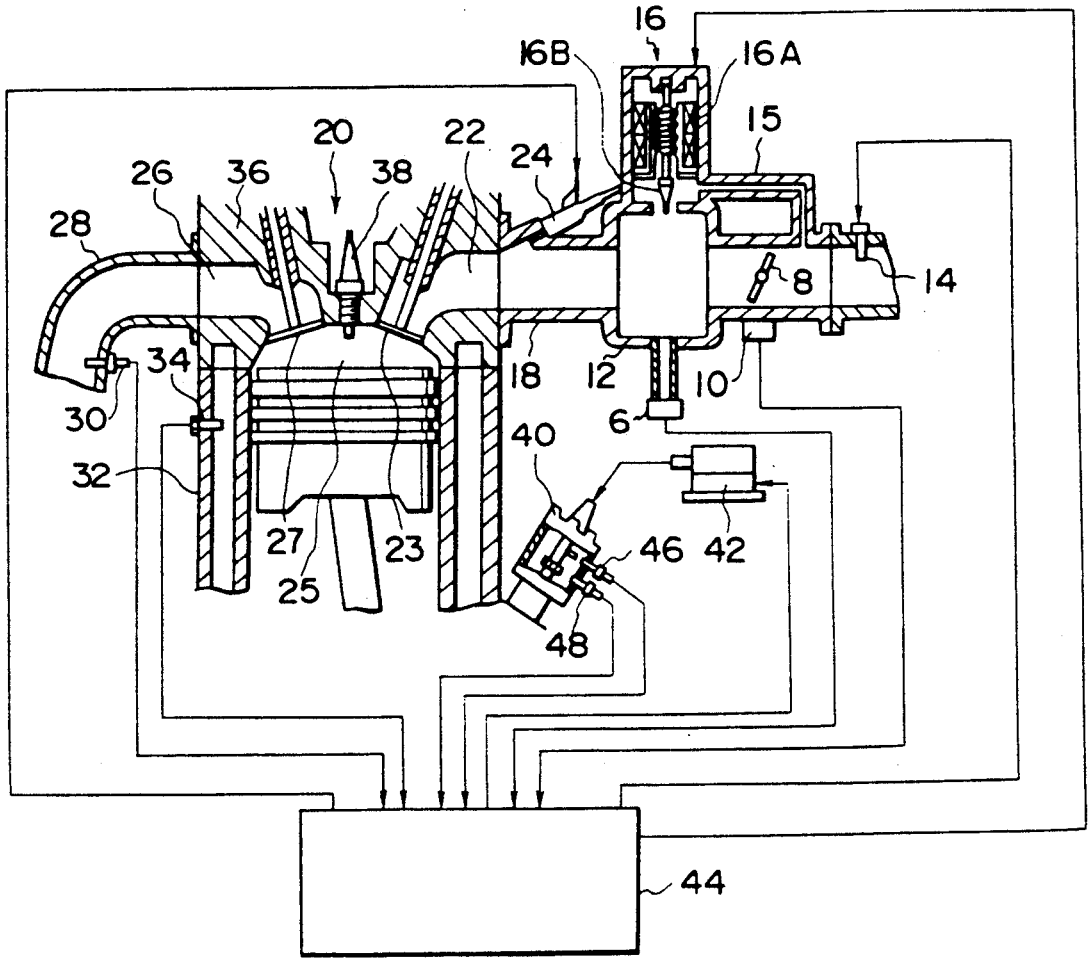
FIG. 5 is an schematic diagram of an internal combustion engine provided with a fuel injection duration control device in accordance with the invention of this application.
Figure 6:
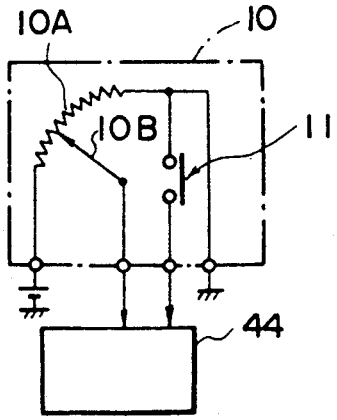
FIG. 6 is an equivalence circuit diagram of a throttle degree of opening sensor.

The following explanation refers to an internal combustion engine provided with a fuel injection apparatus according to this invention. As is shown in FIG. 5, an air temperature sensor 14 and a throttle valve 8 are provided on the downstream side of the air cleaner (not indicated in the figure). Throttle valve 8 is provided with a throttle degree of opening sensor 10 to detect the degree of opening of the throttle valve. As shown in the equivalence circuit in FIG. 6, the throttle degree of opening sensor 10 comprises a contact 10B fixed to the rotating shaft of the throttle valve 8, and a variable resistor 10A w.:th one terminal connected to a power source and the other terminal connccted to a ground, so that when there is a change in the degree of opening of the throttle valve 8, the state of contact between the variable resistor 10A and the contact 10B changes so that a voltage in accordance with the degree of throttle opening can be obtained from contact 10B. Also, inside the throttle degree of opening sensor 10 is provided an idle switch 11 that turns on when the throttle is fully closed (i.e. during idling). The wall of the intake pipe on the side upstream of the throttle valve 8 is provided with an air temperature sensor 14 comprising a thermistor to detect the temperature of the intake air. Downstream of the throttle valve 8 is provided a surge tank 12 to which is mounted a pressure sensor 6 of the diaphragm type or the semiconductor type. Also provided is a bypass 15 linking the side upstream of the throttle valve and the side downstream of the throttle valve so as to bypass the throttle valve. This bypass 15 can be provided with, for example, ISC valve 16 comprising a pulse motor 16A provided with a 4-pole stator, and a valve 16B for which the degree of opening is controlled by the pulse motor. The surge tank 12 is linked with the combustion chamber 25 of the engine 20 via an intake manifold 18, air intake port 22 and an air intake valve 23. The air pipes of the intake manifold 18 are mounted with fuel injection valve(s) 24 so that fuel can be injected into the pipes individually, in groups, or all at once.

A combustion chamber 25 is linked via an air discharge valve 27, an air discharge port 26 and an exhaust manifold 28, to a catalytic device (not indicated in the diagram) filled with a ternary catalyst. Exhaust manifold 28 is mounted with an $O_2$ sensor 30 that detects the concentration of residual oxygen in the discharged gas and outputs signals inverted around the value corresponding to the theoretical air-fuel ratio.

A cooling water temperature sensor 34 is mounted to the cylinder block 32 so as to protrude into the water jacket and comprising thermistors or the like to detect the temperature of the engine cooling water as being representative of the temperature of the engine. Spark plugs 38 are mounted to the cylinder head 36 so as to protrude into each of the combustion chambers 25. The spark plugs 38 are connected to a control circuit 44 comprising a microcomputer or the like, via a distributor 40 and an igniter 42 provided with an ignition coil. The distributor comprises an air pipe judgment sensor 46 and degree of rotational angle sensor 48 comprising each of the pick-ups fixed to the distributor housing and a signal rotor fixed to the distributor shaft. The air pipe judgment sensor 46 outputs the air pipe judgment signals for each 720° CA, for example. The engine speed can then be computed from the cycle of these signals for the degree of rotational angle.

Figure 7:
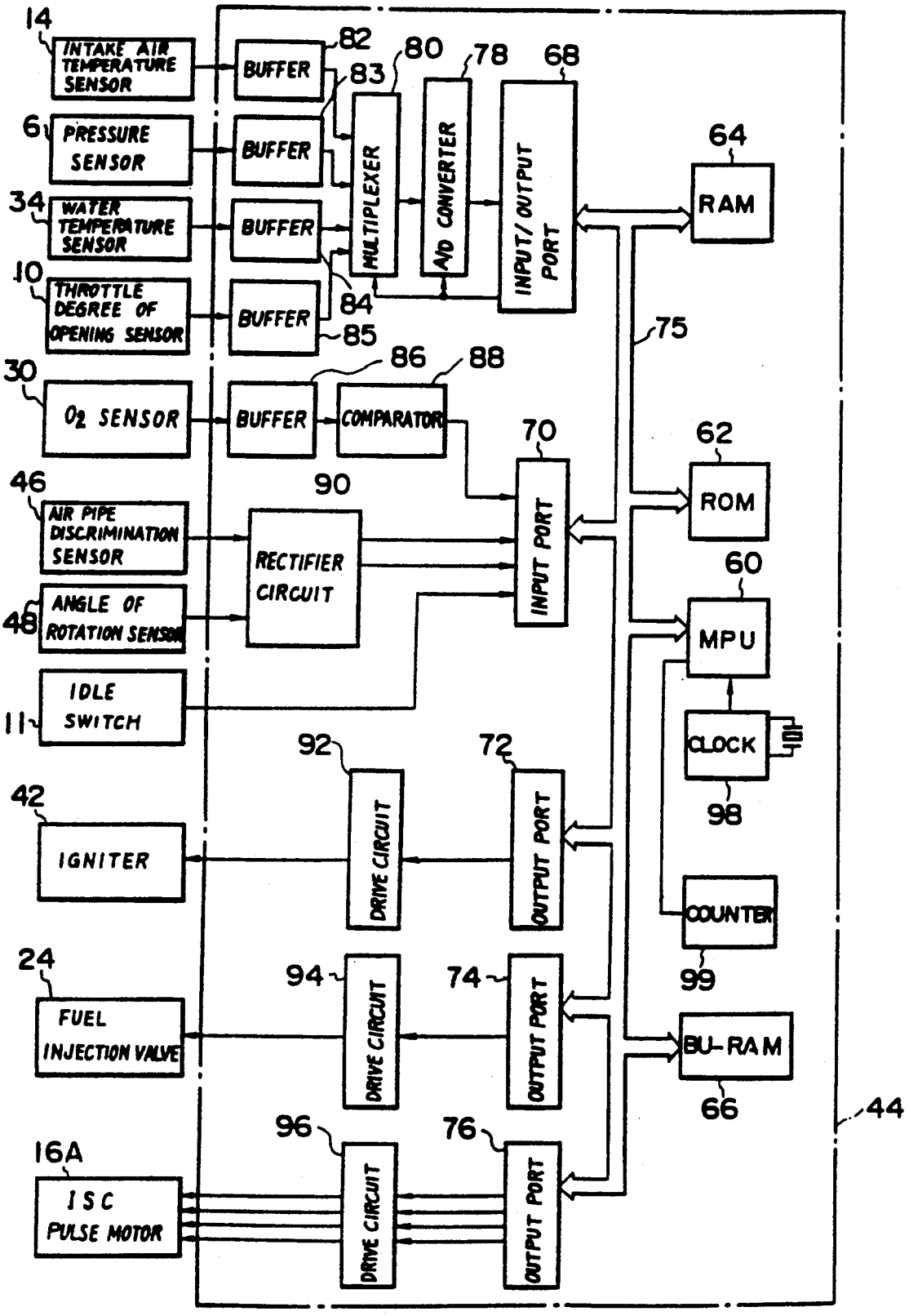
FIG. 7 is a block diagram indicating details of the control circuit of FIG. 6.

As shown in FIG. 7, the control circuit 44 comprising the microcomputer or the like is provided with a microprocessing unit (MPU) 60, a read.only memory (ROM) 62, a random access memory (RAM) 64, a backup RAM (BU.RAM) 66, and input/output port 68, output ports 72, 74 and 76, and a data bus and control bus or the like connecting them. The input/output port 68 is connected to an analog/digital (A/D) converter 78 and a multiplexed 80, in order, and the multiplexer 80 is connected via a buffer 82 to an intake air temperature sensor 14, and to a water temperature sensor 34 and a throttle degree of opening sensor 10 via a buffer 84 and a buffer 85, respectively. Moreover, the multiplexer 80 is connected to a pressure sensor 6 via a buffer 83. The input/output port 68 is connected to the analog/digital (A/D) converter 78 and the multiplexer 80, and outputs intake air temperature sensor 14 output in accordance with the control signals from the MPU, pressure sensor 6 output, water temperature sensor 34 output and throttle degree of opening sensor 10 output in sequence and at the required cycle, so as to perform A/D conversion.

An input port 70 is connected to an $O_2$ sensor 30 via a comparator 88 and a buffer 86, and also via a waveform rectification circuit 90 to the air pipe judgment sensor 46 and the degree of angle of rotation sensor 48, and also via a buffer (not shown in the drawing) to an idle switch 1. The output port 72 is connected via a drive circuit 92 to the igniter 42, and an output port 74 is connected via a drive circuit 94 to the fuel injection valve 24, and an output port 76 is connected via a drive circuit 96 to the ISC valve pulse motor 16A.

Figure 8:
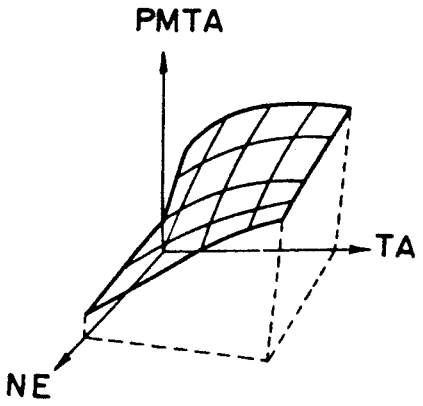
FIG. 8 is a graph indicating the intake pipe pressure PMTA for the constant status.
Figure 9:
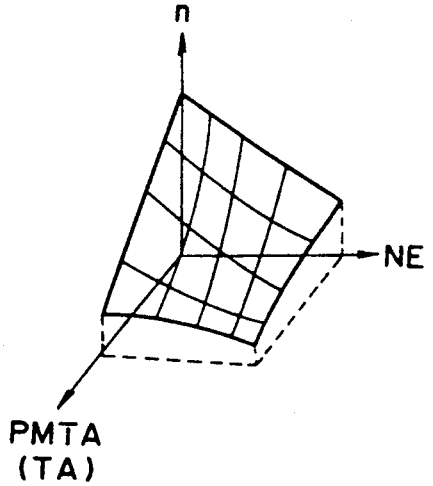
FIG. 9 is a graph indicating a map for the coefficient n relating to the weighting of the value for the weighted average.
Figure 10:
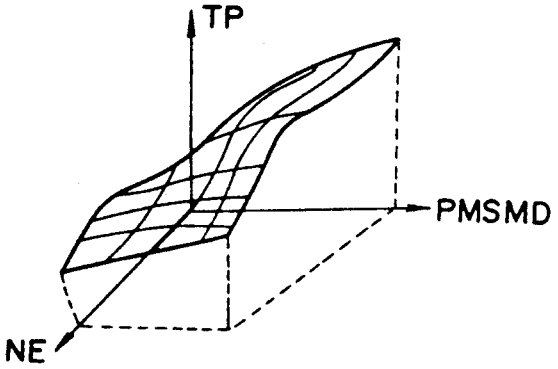
FIG. 10 is a graph indicating a map for the basic fuel injection duration.

In the embodiment of the invention according to this application as described below, the program for the control routine and the map for the intake pipe pressure PMTA for the,constant state as determined by the engine speed NE and the degree of throttle opening TA, the map for the coefficient n relating to the weighting determined by the engine speed NE and the intake pipe pressure PMTA (or the deggee of throttle opening TA) as indicated in FIG. 9, and the map for the basic fuel injection duration TP determined by the engine speed NE and the intake pipe pressure PMSM as indicated in FIG. 10, are stored beforehand in the ROM 62. The map for the intake pipe pressure for the constant state as indicated in FIG. 8, is created by setting the degree of throttle opening TA and the engine speed NE, measuring the intake pipe pressure corresponding to the set degree of throttle opening TA and the engine speed NE, and by using the values for when the intake pipe pressure has stabilized. The map for the coefficient n relating to the weighting as indicated in FIG. 9, is created by measuring the time constant T for the response time (initial response) of the intake pipe pressure when the throttle is opened to a step state, and by by determining $T/\Delta t(\approx n)$ from this measured value and the execution cycle $\Delta t$sec so as to correspond to the engine speed NE and the actual intake pipe pressure PMTA (or the degree of throttle opening TA). The basic fuel injection duration TP map shown in FIG. 10 is created by setting the engine speed and the intake pipe pressure and measuring the basic fuel injection duration TP for the objective air-fuel ratio (for example, the theoretical air-fuel ratio).

Figure 11:
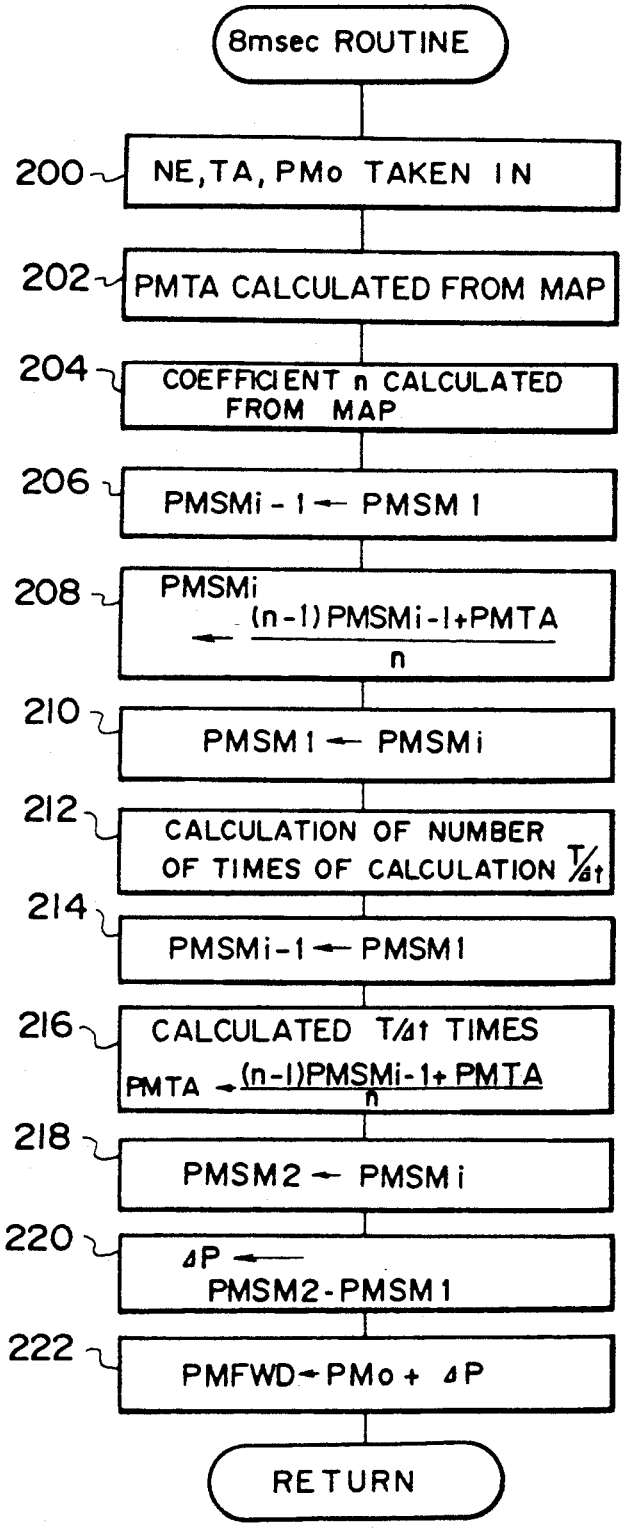
FIG. 11 is a flow chart indicating a routine for accurately calculating the predicted vlaue PMFWD.
Figure 14:
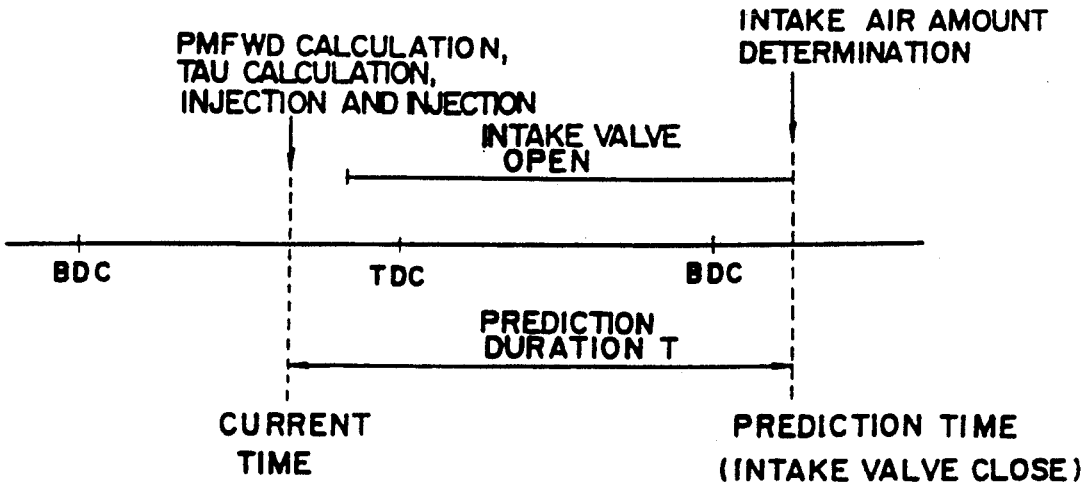
FIG. 14 is a graph indicating the relationship between the current time and the prediction time, etc.

In the following, the routine for the calculation of the predicted intake pipe pressure PMFWD is explained. with reference to FIG. 11. This routine is executed for each required duration (for example, 8 msec). In step 200, the engine speed NE, the A/D converted value TA for the degree of throttle opening TA. and the current intake pipe pressure PMe detected by the pr.essure sensor are taken. In step 202, the intake pipe pressure PMTA for the constant state and corresponding to the engine speed NE and the degree of throttle opening TA, is calculated from the map shown, in FIG. 8. In the following step 204, the coefficient n relating to the weighting, is calculated from the map shown in FIG. 9. In the following steps 206 and 208, the weighted average value $PMSM_{i-1}$ that was previously calculated and stored in the register PMSM1 is read and used with formula (23) as the basis for calculating the weighted average value $PMSM_i$ for this time. In step 210, this weighted average value $PMSM_i$ is stored in register $PMSM_i$. In the following step 212, the number of times of calculation $T/\Delta t$ is calculated by dividing the duration Tmsec from the current time until the intake pipe pressure prediction time, by the calculation duration Δt (=8 msec) for the routine of FIG. 11. As can be seen from FIG. 14, this prediction duration is the duration from the present until the intake pipe pressure prediction time. This is to say, it uses the time from the present until the closing of the intake valve. In cases where the fuel is not injected into each of the air pipes individually, this time is determined by the time it takes for the fuel to travel from the fuel injection valve to the combustion chamber but even if the crank angle from the current time until the prediction time is the same, this prediction duration Tmsec will become shorter for the faster the engine speed and so will vary undesirably in accordance with the engine speed and other conditions of engine operation (so that it will for example, become shorter as the engine speed increases). In the following step 214, the value stored in register PMSM1 is made the weighted average $PMSM_{i-1}$ and then in step 216, formula (23) is repeatedly executed for the number of times of calculation T/Δt, and in step 218, the value thus calculated is stored in register PMSM2. In this way, the repeated execution of the calculation for the weighted average value means that the value for the weighted average approaches the value for the intake pipe pressure for the constant operation state. Therefore, by determining the number of times of calculation of the value for the weighted average as described above, it is possible to calculate a value close the intake pipe pressure (intake pipe pressure in a state closer to the constant state than at the present time) Tmsec in advance of the present time.

In the following step 220, the value stored in register PMSMl (calculated intake pipe pressure for the present time) is subtracted from the value stored in register PMSM2 (calculated intake pipe pressure for prediction time) to give the difference ΔP, so that in the following step 22, the measured intake pipe pressure $PM_0$ at the present time (current measured value) and the difference ΔP are added to give the value for the predicted value PMFWD.

Figure 15:
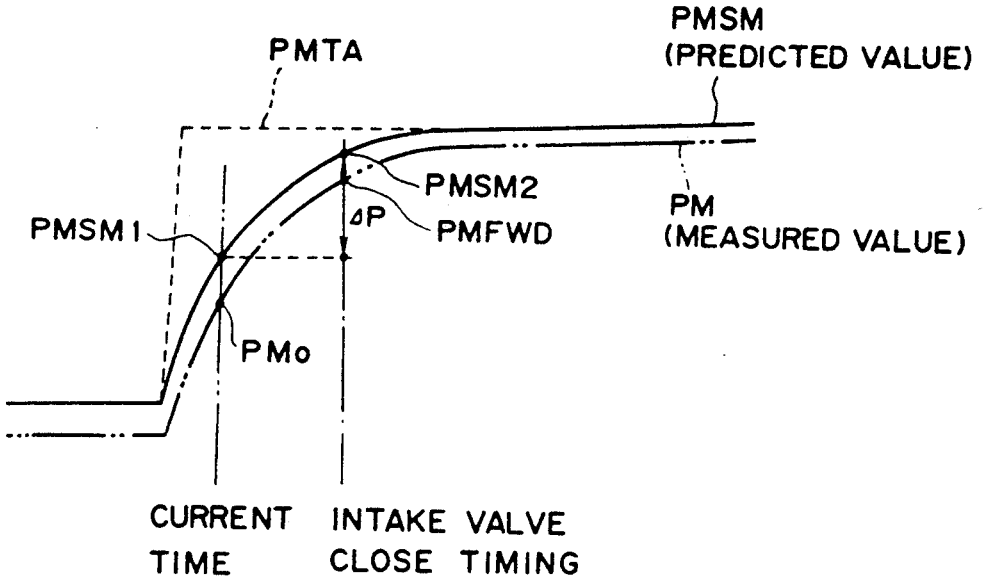
FIG. 15 is a graph indicating the relationship between the predicted value and the measured value, etc.

FIG. 15, shows the relationship between the measured value, the intake pipe pressure calculated at the current time, the intake pipe pressure calculated for the prediction time, and the predicted value PMFWD, etc.

Figure 12:
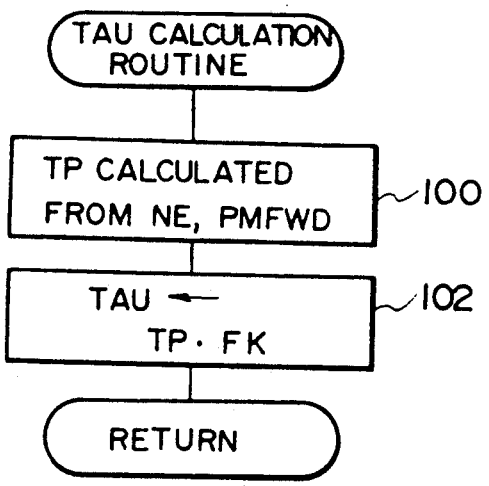
FIG. 12 is a flow chart indicating a routine for calculating the fuel injection duration.
Figure 13:
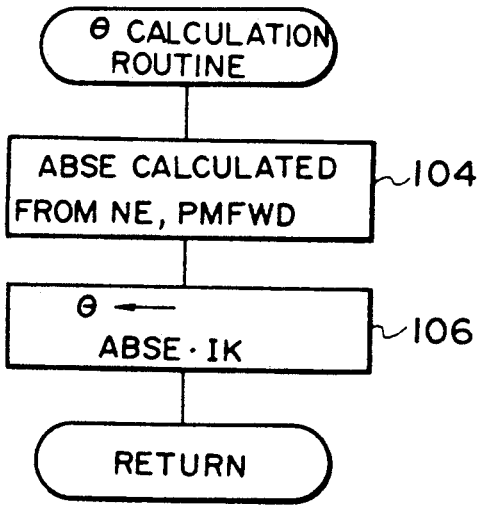
FIG. 13 is a flow chart indicating a routine for calculating the spark lead angle used.

The predicted value PMFWD determined in the manner described above, is used to calculate the fuel injection duration TAU and the spark lead angle θ used. This is to say that as shown in FIG. 12, in step 100, the basic fuel injection duration is calculated on the basis of the engine speed NE and the predicted value PMFWD, and the fuel injection duration TAU is calculated by using the correction coefficient FK determined by the intake air temperature and the engine cooling water temperature to correct the basic fuel injection duration TP of step 102. Furthermore, as shown in FIG. 13, the predicted value PMFWD and the engine speed NE of step 104 are used as the basis for calculating the basic spark lead angle ABSE, and in step 106, the basic spark lead angle ABSE is corrected by the correction coefficient IK determined by the intake air temperature and the engine cooling water temperature, to give the spark lead angle θ used. The fuel injection duration TAU and the spark lead angle θ used are then used to control the fuel injection amount and the spark timing.

Figure 18:
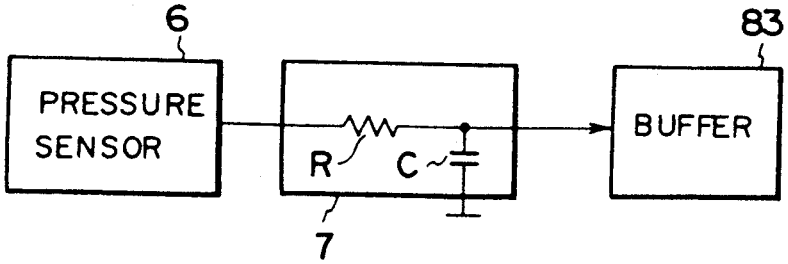
FIG. 18 is a circuit diagram of a filter connected to the pressure sensor.

The intake pipe pressure has a pulsation component. As shown in FIG. 18, in order to remove this pulsation component, the time coefficient can be made small (for example, 3 to 5 msec) and the output sensor output can be processed by a filter such as a CR filter or the like, having a good response characteristic, and used to control the ignition timing and the fuel injection amount. In these cases, a difference in the time constant of the filter is generated even if the predicted value is calculated using the manner described in the above embodiment. Because of this, the intake pipe pressure for the current time calculation is digitally processed according to the following formula (24) so that a time constant the same as the filter time constant is generated, and the difference ΔP is calculated according to formula (25) to calculate the predicted value PMFWD ($=PM_0+\Delta P$):

$$PMSM1S_1 \longleftarrow \frac{(m-1)PMSM1S_{i-1} + PMSM1}{m} \quad (24)$$

$$P \longleftarrow PMSM2 - PMSM1S_i \text{ wherein} \quad (25)$$

m is a value determined by a time constant and $PMSM1S_{i-1}$ is the weighted average that was calculated the previous time.

Figure 16:
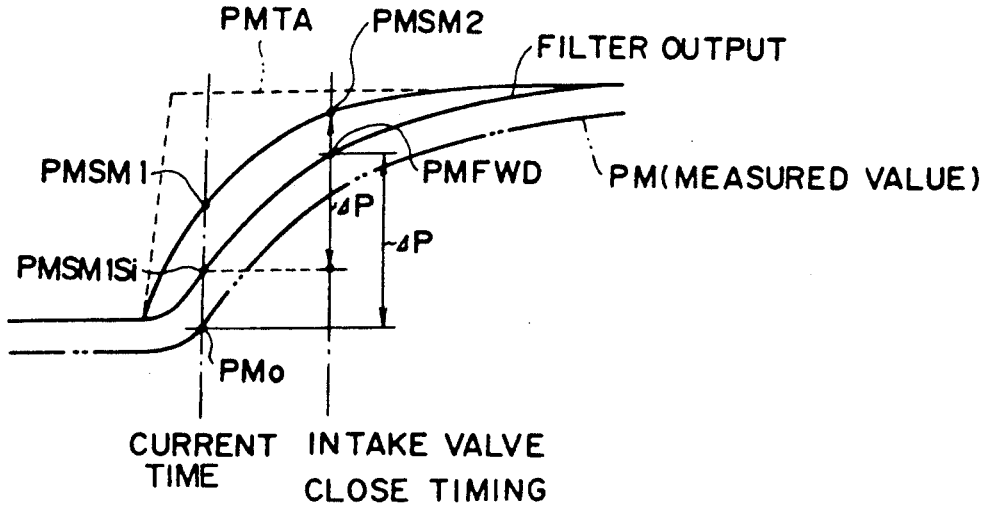
FIG. 16 is a graph indicating the relationship between the predicted value, the measured value and the filger output, etc.

FIG. 16 shows the relationships between $PM_0$, $PMSM1S_i$, PMFWD and ΔP. Furthermore, in the above explanation, the intake pipe pressure PMSM1 at the current time and calculated from the intake pipe pressure at the prediction time, was calculated calculating the predicted value PMFWD resulting from adding the measured value $PM_0$ at the current time and the reduced difference ΔP. However, PMSM2 can be reduced by ($PMSM1-PM_0$) and the predicted value PMFWD calculated.

Figure 17:
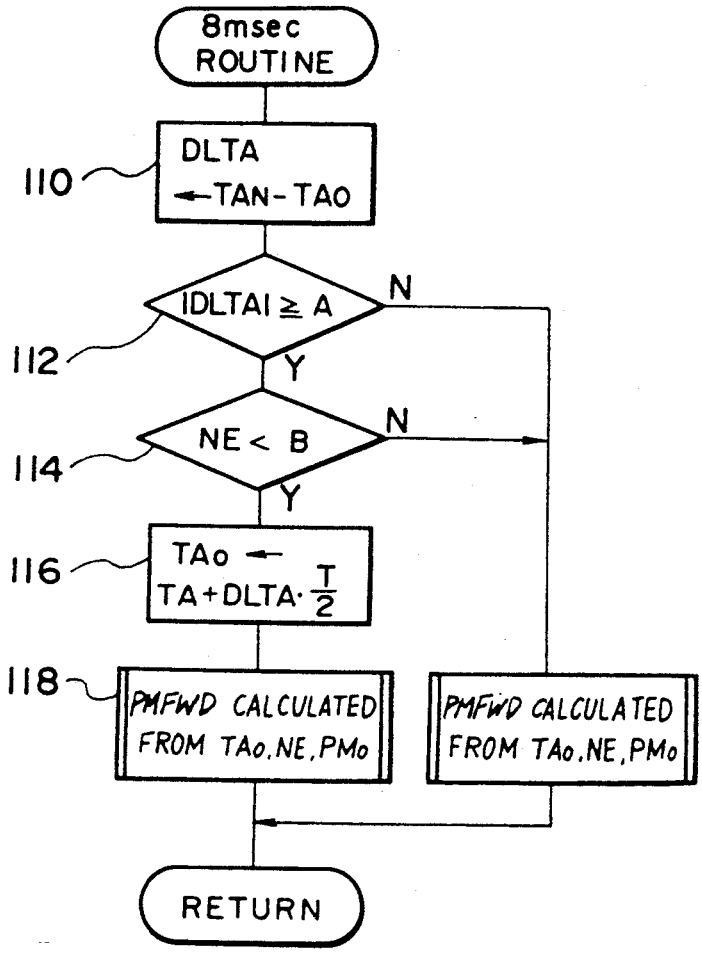
FIG. 17 is a flow chart indicating the routine of an other embodiment according to the invention of this application.

The following explanation is of a second embodiment of the invention according to this application, and with reference to FIG. 17. In this embodiment, the required degree of throttle opening is predicted in advance when the output of change of the degree of opening of the throttle is large, and the predicted value for the intake air pressure is calculated.

First of all, in step 110, the degree of throttle opening $TA_O$ taken last time is subtracted from the degree of throttle opening $TA_N$ taken this time and the amount of change DLTA for the degree of throttle opening is calculated. In step 112, it is judged whether or not the absolute value of the amount of change DLTA for the degree of throttle opening is equal to or greater than a certain value A. If the absolute value |DLTA| of the amount of change DLTA for the degree of throttle opening is less than the certain value A, then in step 120, the degree of throttle opening TA, the engine speed NE and the measured value $PM_O$ for the intake pipe pressure are used to calculate the predicted value PMFWD in the same manner as was shown in FIG. 11. Conversely, if the absolute value |DLTA| of the amount of change DLTA for the degree of to or greater than the certain throttle opening is equal value A, in step 114 it is judged whether or not the engine speed NE is less than a certain value B. If the engine speed NE is less than the certain value B, in step 116, the following formula is used to calculate the predicted value $TA_O$ for the degree of throttle opening.

$$TA_0 \leftarrow TA + DLTA \cdot \frac{T}{2} \quad (26)$$

The T in the above formula (26) is the duration from the current time until the prediction time and so the predicted value $TA_O$ indicates the degree of throttle opening in the duration between the current time and the prediction time. Then, in the following step 118', the degree of throttle opening TA in FIG. 11 is replaced by the predicted value $TA_O$ to calculate the predicted value PMFWD in the same manner as described above.

In step 114, when it has been judged that the engine speed NE is equal to or greater than the certain value B to be in the high.speed region, then in step 120, the predicted value PMFWD for the intake pipe pressure is determined without prediction of the degree of throttle opening. In this way, by prohibiting prediction of the degree of throttle opening in the high.speed region, hunting for the predicted value due to vibration, etc. at high speeds is avoided.

The above has explained an example of measuring the intake pipe pressure and accurately calculating a predicted value but an air flow meter or the like can also be used to measure the intake air amount and calculate an accurate predicted value.

Figure 19:
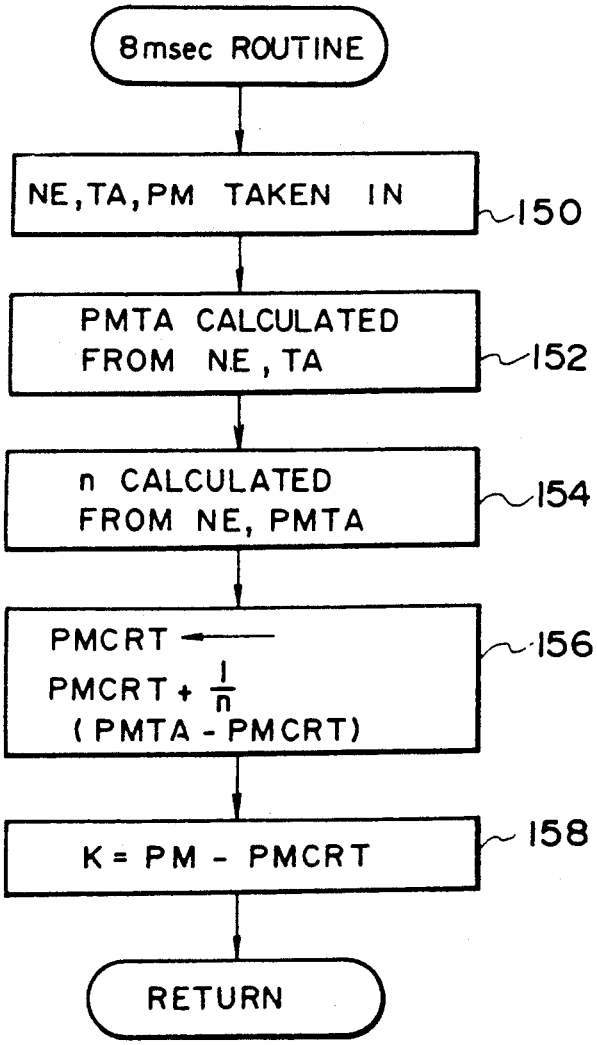
FIG. 19 is a flow chart indicating a routine for calculating the correction coefficient K of a third embodiment according to the invention of this application.

The following explanation concerns the correction of the predicted value in a third embodiment of the invention according to this application. In an engine provided with the bypass indicated in FIG. 5, it is possible for errors (which are greater for lighter loads) in the intake pipe pressure due to flow control of the bypass and errors (which are greater for heavier loads) due to atmospheric pressure, to be generated. Therefore, in this embodiment, there is correction for the errors due to the influence of the amount of air flowing in the bypass and for errors due to the lowering of the atmospheric pressure. The first part of the explanation deals with the 8 msec routine embodiment of the invention according to this application. and with reference to FIG. 19. In step 150, the engine speed NE, the degree of throttle opening TA after it has undergone A/D conversion, and the intake pipe pressure PM that has undergone A/D conversion after having been input via the CR filter are taken. The intake pipe pressure PMo that has not been processed by the CR filter can be used instead. Moreover, the A/D conversion for the degree of throttle opening and the intake pipe pressure is performed by an interrupt routine (not indicated in the figure) that is executed cyclically (for example, each 8 msec). In the following step 152, the engine speed NE and the degree of throttle opening TA are used to calculate the intake pipe pressure PMTA for the constant status, from the map shown in FIG. 8. In the following step 154, the coefficient n relating to the weighting for the intake Pipe pressure PMTA for the constant status, as calculated from the engine speed NE and the degree of throttle opening TA, is calculated from the map shown in FIG. 9.

In the next step 156, the following formula is used to calculate the current intake pipe pressure PMCRT.

$$PMCRT \leftarrow PMCRT + \frac{1}{n}(PMTA - PMCRT) \quad (27)$$

The intake pipe pressure PMCRT calculated by the above formula (27) has the possibility of including errors due to the amount of air flowing in the bypass and so in step 158, the intake pipe pressure PMCRT is subtracted from the intake pipe pressure PM detected by the pressure sensor, to give the correction coefficient K.

Figure 20:
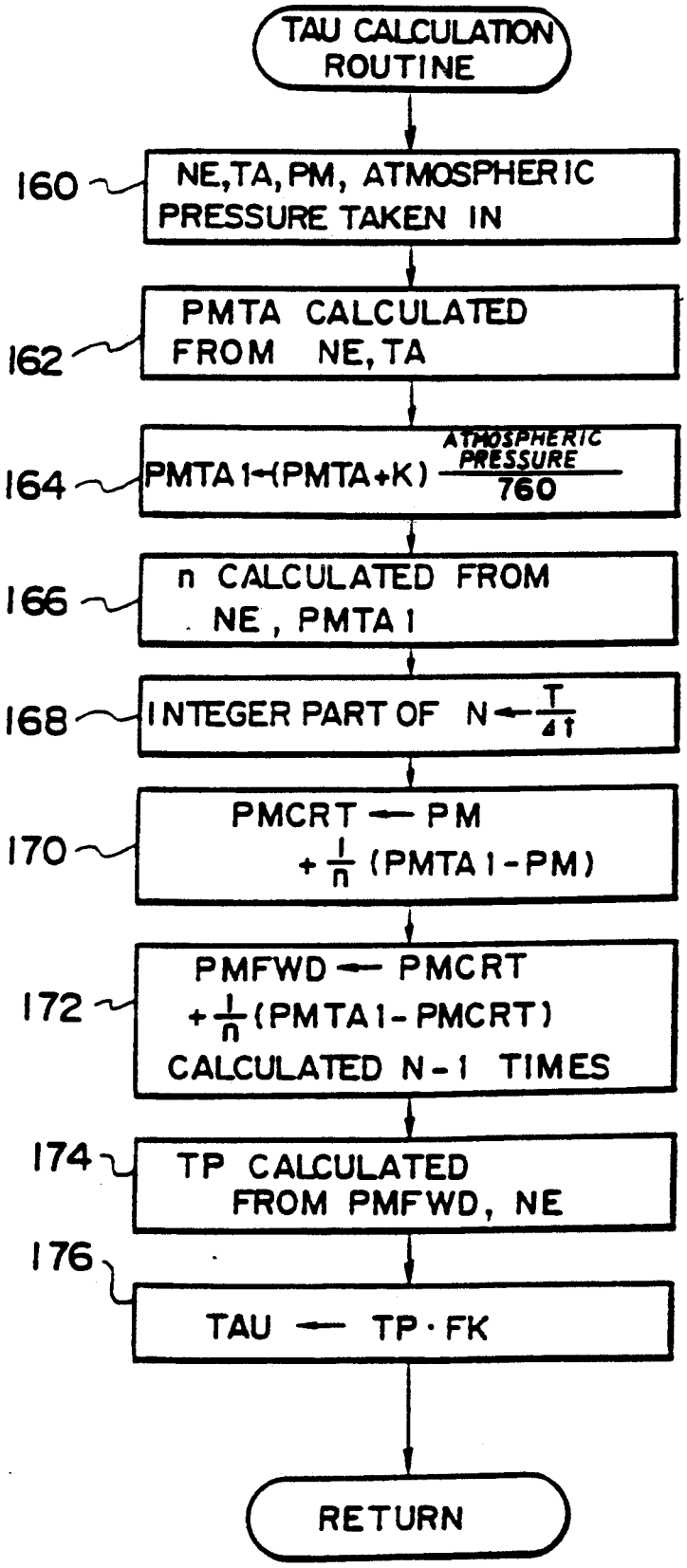
FIG. 20 is a flow chart indicating a routine for calculating the fuel injection duration in the third embodiment according to the invention of this application.

FIG. 20 shows the routine used to calculate the fuel injection duration TAU and in step 160, takes in the engine speed NE, the degree of throttle opening TA, the intake pipe pressure PM and the atmospheric pressure. Here, the output of the pressure sensor 6 when the engine starts, or the output of the pressure sensor 6 when the throttle is fully open, can be used as the value indicating the atmospheric pressure but an atmospheric pressure sensor can be mounted for the detection of the atmospheric pressure.

In the following step 162, the engine speed NE and the degree of throttle opening TA are used as the basis to determine the intake pipe pressure PMTA for the constant status, in the same manner as described above. This intake pipe pressure PMTA has the possibility of including errors due to the amount of air flowing in the bypass and errors due to the lowering of the atmospheric pressure, and so correction by the following formula is performed using the correction coefficient K calculated in step 158 of the FIG. 19 routine.

$$PMTA1 \leftarrow (PMTA + k) \cdot \frac{\text{atmospheric pressure}}{760} \quad (28)$$

In the next step 166, the engine speed NE and the intake pipe pressure PMTA1 for the constant state and corrected by formula (28) are used in the same manner as above to determine the coefficient n relating to the weighting.

In the following step 168, the number of times of calcualtion $N = T/\Delta t$ from the current time until the intake pipe pressure prediction time is calculated, is calculated in the same manner as in step 212 by dividing the duration Tmsec from the current time until the intake pipe pressure prediction time, by the calculation duration $\Delta t$ (= 8 msec) for this routine. In the following step 170, the intake pipe pressure PM detected by the pressure sensor and A/D converted via the CR filter, the coefficient n relating to the weighting, and the corrected intake pipe pressure PMTA1 for the constant status are used to calculate the initial value for the PMCRT according to the following formula.

$$PMCRT = PM + \frac{1}{n}(PMTA1 - PM) \quad (29)$$

In the following step 172, the initial value for the PMCRT calculated in step 168, the weighting coefficient n and the intake pipe pressure PMTA1 for the constant status are used for the following formula to repeatedly calculate the value for the weighted average N − 1 times and therefore calculate the predicted value for the intake pipe pressure.

$$PMFWD \leftarrow \left( PMCRT + \frac{1}{n}(PMTA - PMCRT) \right) \quad (30)$$

calculated $N - 1$ times

As has been explained above, the predicted value PMFWD for the intake pipe pressure is determined by repeated calculation N times, of the value for the weighted average, using the intake pipe pressure PM detected by the pressure, sensor as the initial value.

In the next step 174, the predicted value PMFWD for the intake pipe pressure and the engine speed NE are used as the basis for calculating the basic fuel injection duration TP, and in step 176, the basic fuel injection duration TP is corrected by the correction coefficient K determined by the air temperature and the engine cooling water temperature, etc., to calculate the fuel injection duration TAU.

Then, in the fuel injection amount control routine (not indicated in the figure), the fuel injection valve opens,at the fuel injection timing, for a duration equivalent to the fuel injection duration TAU, so that the amount of fuel injected is controlled.

Figure 28:
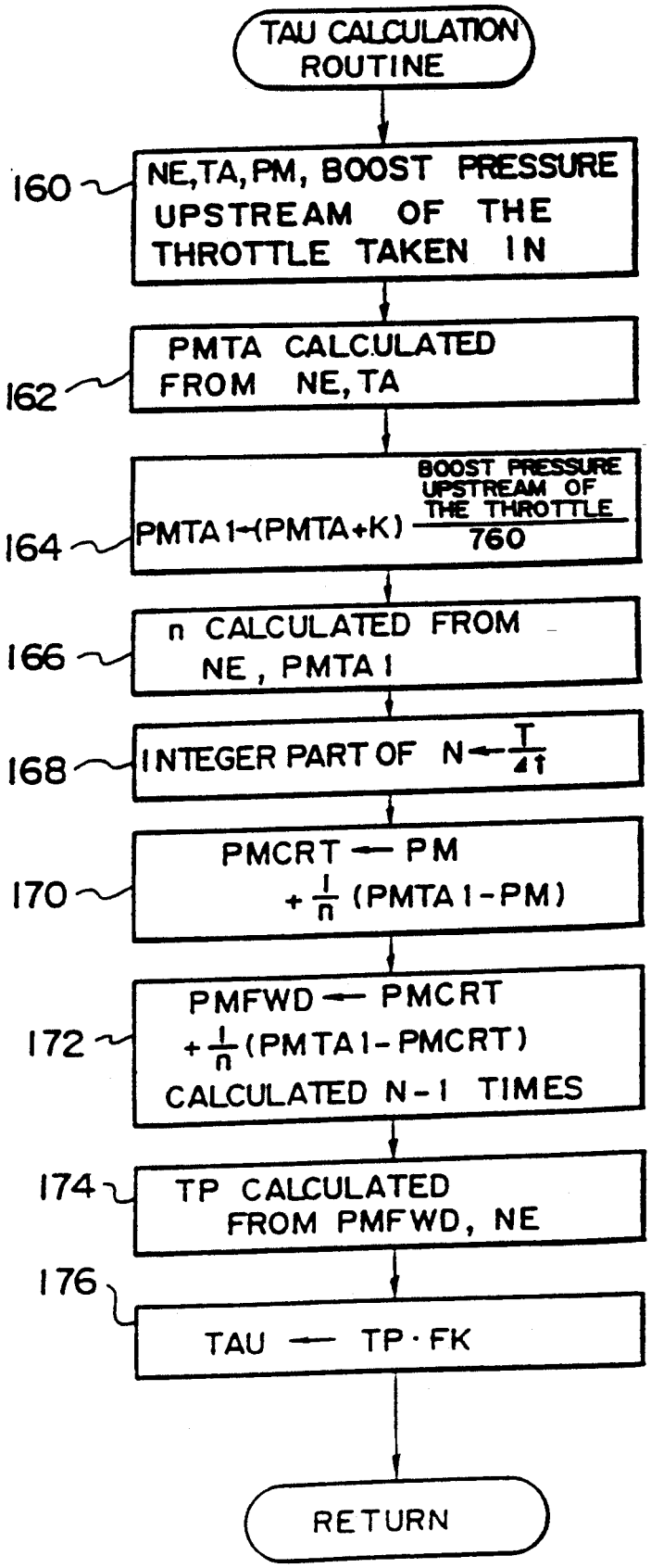
FIG. 28 is a flow chart indicating a routine for calculating the fuel injection duration in a modification of the third embodiment according to the invention of this application.

The following explanation relates to correction in internal combustion engines fitted with superchargers. These engines have a pressure sensor mounted on the upstream side of the throttle, to detect the pressure. Then, in step 160 of FIG. 20, the atmospheric pressure is replaced by the pressure on the side upstream of the throttle and in step 164 of FIG. 20, correction is performed on the basis of the formula below as shown respectively in steps 160 and 164 of FIG. 28, and the fuel injection duration is calculated in the same manner as for the embodiment described above.

$$PMTA \leftarrow (PMTA + K) \cdot \frac{\text{pressure upstream of the throttle}}{760} \quad (31)$$

In this case, the table in FIG. 8 is created using the values measured at air pressure when the supercharger is not operating.

Figure 21:
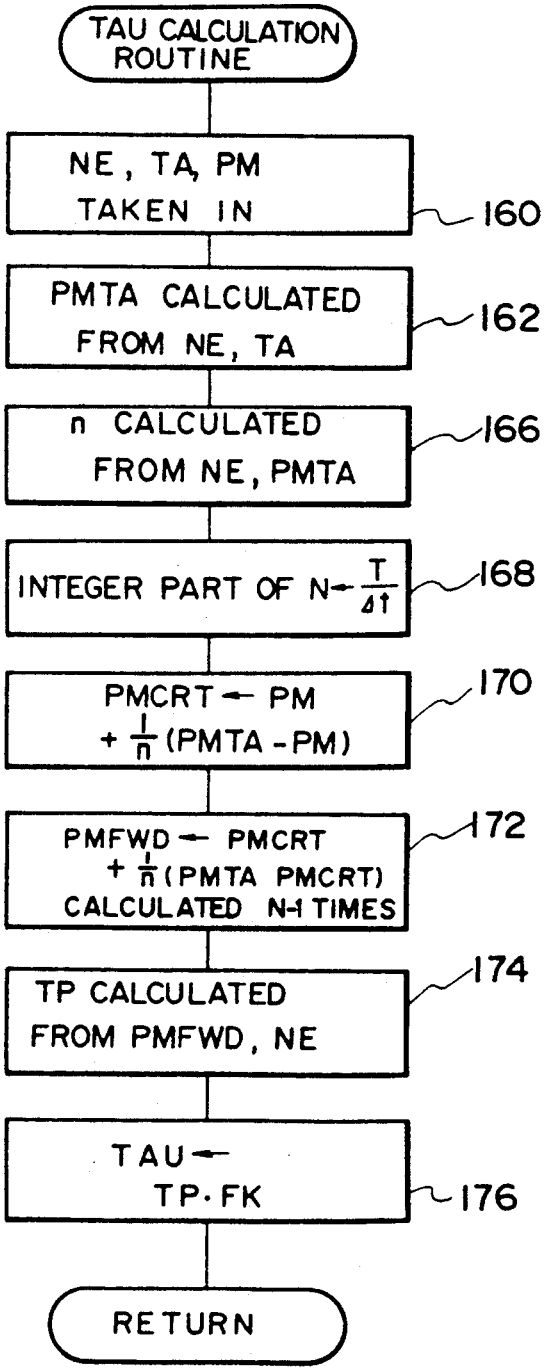
FIG. 21 is a flow chart indicating a routine for calculating the fuel injection duration in a fourth embodiment accordin.g to the invention of this application.

FIG. 21 indicates a routine for calculating the fuel injection duration TAU in a fourth embodiment of the invention of this application. The routine of FIG. 21 corresponds to that of FIG. 20 with the following diffence Step 160 in FIG. 21 differs from FIG. 20 in that the atmospheric pressure is not taken into account. Also, PMTA in FIG. 21 differs from PMTA1 in FIG. 20 in that it is the intake pipe pressure (as in step 152) for the constant status and which has not been corrected by correction coefficient K.

Figure 23:
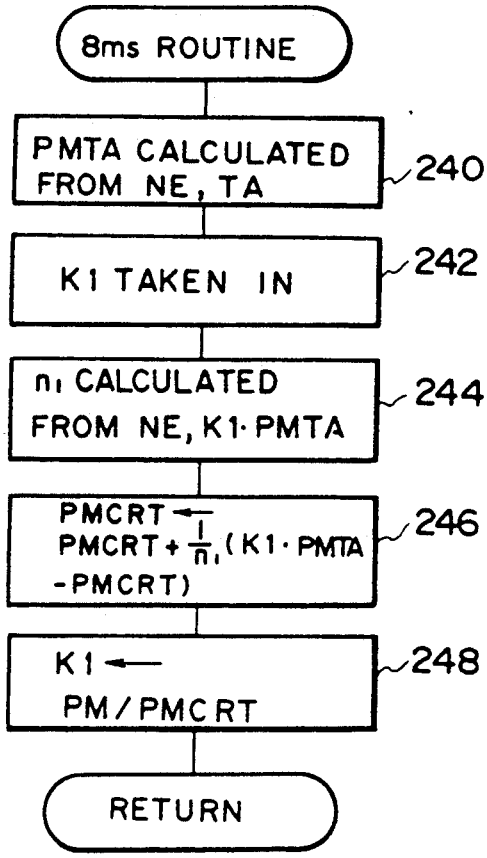
FIG. 23 is a flow chart of a routine for calculating the correction coefficient in the fifth embodiment according to the invention of this application.
Figure 24:
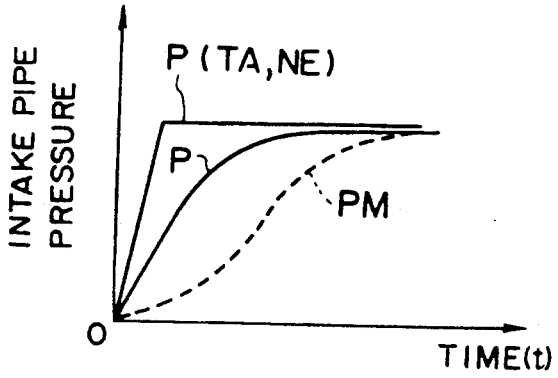
FIG. 24 is a graph indicating the difference between the intake pipe pressure conventionally determined by the degree of throttle opening and the engine speed, and the actual intake pipe pressure.
Figure 25:
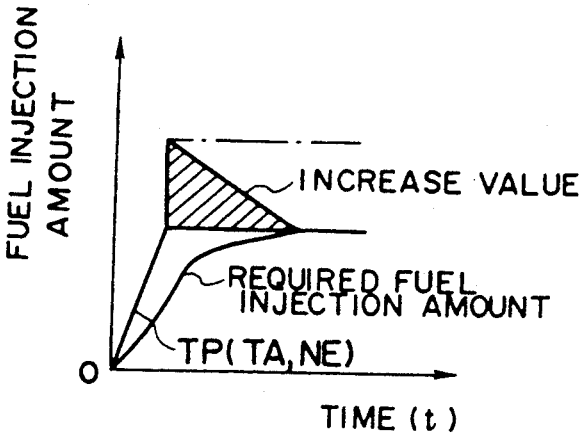
FIG. 25 is a graph indicating the difference between the required fuel injection duration and the fuel injection duration conventionally determined by the degree of throttle opening and the engine speed, and the actual intake pipe pressure.
Figure 26A:
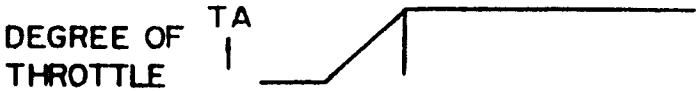
FIG. 26 (A), (B) and (C) are graphs indicating the degree of throttle opening, the intake pipe pressure PMTA and the changes in the current intake pipe pressure PMCRT for a naturally aspirating engine.
Figure 26B:
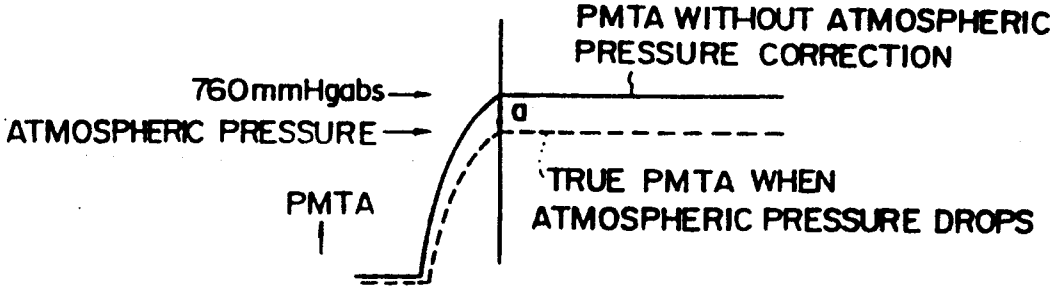
Figure 26C:
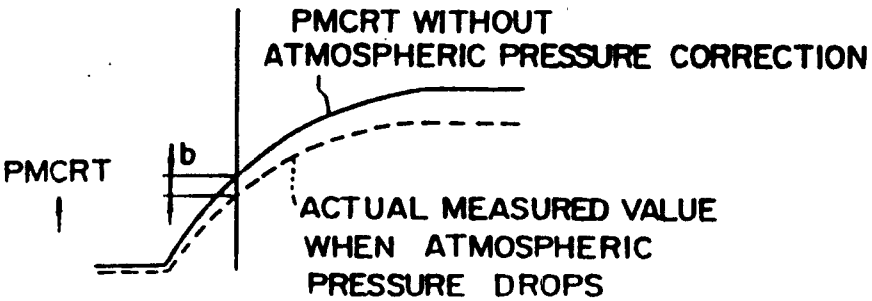
Figure 27A:
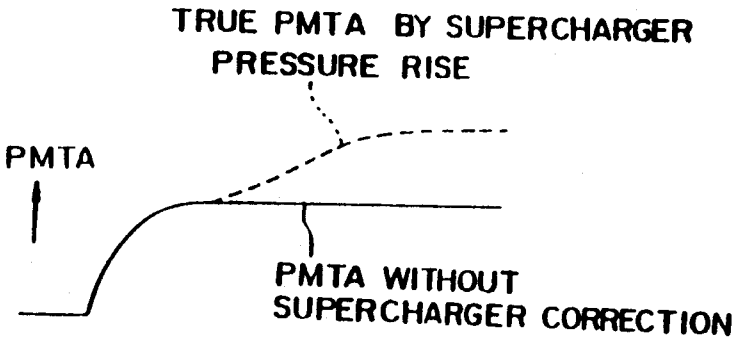
FIG. 27 (A) and (B) are graphs indicating the intake pipe pressure PMTA and the changes in the current intake pipe pressure PMCRT for an engine fitted with a supercharger.
Figure 27B:
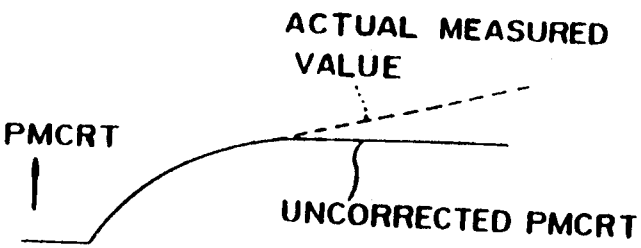

The following explanation relates to a routine in a fifth embodiment according to the invention of this application. FIG. 23 indicates a routine that is executed in a certain cycle (for example, each 8 msec) and so in step 240, the map indicated in FIG. 8 and created from the engine speed NE and the degree of throttle opening TA is used as the basis for the calculation of the intake pipe pressure PMTA for the constant status. In the next step 242, the correction coefficient K that has been calculated and then stored in the RAM, is taken into account and in step 244, the engine speed NE and the intake pipe pressure K1·PMTA for the constant status and corrected by the correction coefficient Kl are used to calculate the coefficient nhd 1 relating to the weighting, from the map indicated in FIG. 9. Then in the next step 246, the weighted average PMCRT is calculated using the following formula, and in step 248, the ratio PM/PMCRT for the intake pipe pressure PM detected by the pressure sensor with respect to the value for the weighted average PMCRT calculated in step 246, is stored in the specified area of the RAM as the correction coefficient K1.

$$PMCRT \leftarrow PMCRT + \frac{1}{n_1}(K1 \cdot PMTA - PMCRT) \quad (32)$$

Here, the ratio beteen the intake pipe pressure PM, and the weighted average PMCRT, i.e. the correction coefficient K1, is considered as the difference that the intake pipe pressure for the constant status has with respect to the actual intake pipe pressure PM, and which causes the discrepancy with the map in FIG. 8. $K1=1$ when there is no error, and $K<1$ when the calculated intake pipe pressure (i.e. the weighted average PMCRT) is greater than the detected intake pipe pressure PM, and $K>1$ when the calculated intake pipe pressure is smaller than the detected intake pipe pressure. Accordingly, when the calculated intake pipe pressure is smaller than the detected intake pipe pressure, the correction coefficient K1 becomes larger than 1 and the intake pipe pressure PMTA for the constant status is corrected so as to become larger, and when the calculated intake pipe pressure is larger than the detected intake pipe pressure, the correction coefficient K1 becomes less than 1 and the intake pipe pressure PMTA for the constant status is corrected so as to become smaller.

Figure 22:
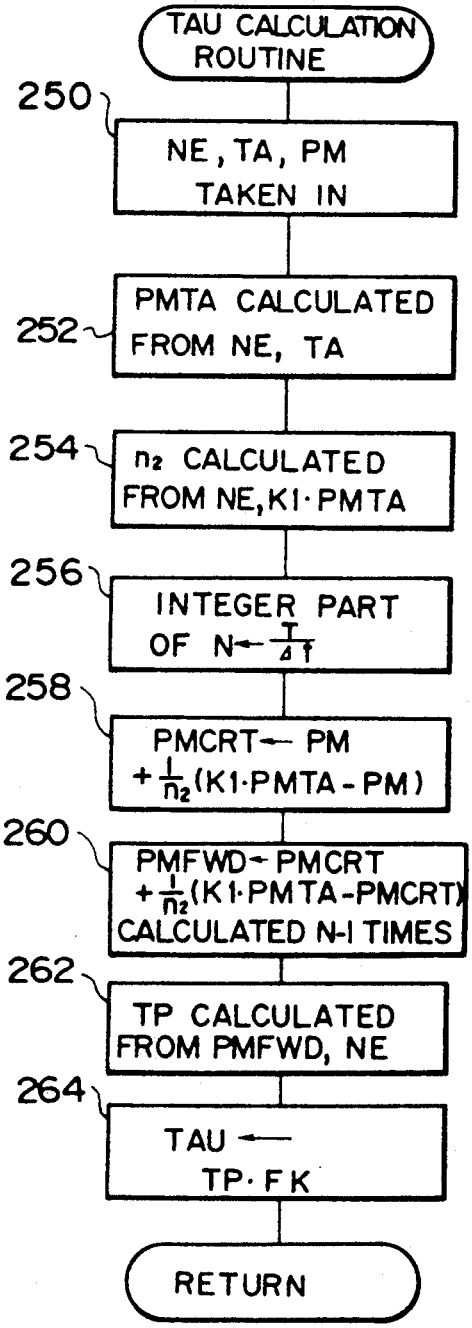
FIG. 22 is a flow chart indicating a routine for calculating the fuel injection duration in the fifth embodiment according to the invention of this application.

FIG. 22 indicates the fuel injection duration time calculation routine executed in a certain cycle (for example, each 8 msec) and so in step 250, the engine speed NE, the degree of throttle opening TA, the intake pipe pressure PM and the correction coefficient Kl are taken in and in step 252, the engine speed NE and the degree of throttle opening TA are used to calculate the intake pipe pressure PMTA for the constant status from the map shown in FIG. 8. In the next step 254, the coefficient n2 relating to the weighting is calculated from the map in FIG. 9 using the engine speed NE and the intake pipe pressure K1·PMTA for the constant status and corrected by the correction coefficient Kl. In the following step 256, the number of times of calculation N is calculated in the same manner as in step 168 in FIG. 21. In the following step 258, the intake pipe pressure PM, the coefficient nz relating to the weighting, the correction coefficient Kl and the intake pipe pressure PMTA for the constant status are used to calculate the initial value PMCRT according to the formula below.

$$PMCRT \leftarrow PM + \frac{1}{n_2}(K1 \cdot PMTA - PM) \quad (33)$$

Then, in step 260, the value calculated by repeating the calculation for the value of the weighted average $N-1$ times using the formula below, is made the predicted value PMFWD for the intake pipe pressure.

$$PMFWD \leftarrow PMCRT + \frac{1}{n_2}(K1 \cdot PMTA - PMCRT): \quad (34)$$

calculated $N-1$ times

As the result of the above, the intake pipe pressure for the constant status, is corrected in accordance with the difference between the detected intake pipe pressure and the calculated intake pipe pressure, and at the same time, the detected initial pipe pressure is made the initial value for repeatedly calculated the weighted average N times, and the value resulting from this calculation is made the predicted value PMFWD for the intake pipe pressure.

Following this, the fuel injection duration TAU is calculated in step 262 and step 264 in the same manner as step 174 and step 176 of FIG. 21.

There are instances where the degree of throttle opening A/D conversion timing executed in a certain cycle, is in agreement with the fuel injection duration calculation timing executed in a certain cycle, but there may be a time delay up to the maximum calculation cycle $\Delta t$ (max). Accordingly, the average of this delay time can be determined as $$\frac{(0 + \Delta t(\max))}{2}$$

and the intake pipe pressure at $$T \pm \frac{\Delta t(\max)}{2}$$

predicted in advance.

The explanation above has used the example of calculation of the weighted coefficient assuming that the degree of throttle opening and the engine speed do not change. However, there are instances where the degree of throttle opening and the engine speed will change over the time Tmsec that elapses from the current time. For this reason, judgment can be made for whether the degree of throttle opening and the engine speed are tending to increase or to decrease, and the weighted coefficient corrected according to predict the intake pipe pressure.

This explanation has dealt with internal combustion engines where the intake air amuont is determined indirectly from the intake pipe pressure, and where the fuel injection duration is controlled. Nevertheless this invention is applicable to internal combustion engines where the intake air amount is determined directly from the air amount passing the side upstream of the throttle, and where the fuel injection duration is controlled.

Furthermore, in the embodiments where only the fuel injection duration control is indicated, the spark timing can also be controlled by a method like that for fuel injection control.

What is claimed is:

1. An internal combustion engine control apparatus comprising:

a first detection means for detecting a degree of throttle opening;

a second detection means for detecting the engine speed;

measurement means for measuring a value of the pressure on a side upstream of the throttle;

prediction means for predicting a value for a future point in a certain period in advance of said current time, of one of the amount of intake air taken into the combustion chamber and a physical quantity corresponding to the intake air amount onthe basis of the degree of throttle opening and the engine speed, a correction means for using the value meaured by said measurement means to correct the value predicted by said prediction means; and a control means to control one of both of the fuel injection duration and the spark timing on the basis of the corrected predicted value and engine speed.

2. An internal combustion engine control appartus according to claim 1, wherein said prediction means calculates an intake pipe pressure for a constant status on the basis of a current degree of throttle opening and a current engine speed, and uses said intake pipe pressure for a constant status to obtain the prediced value.

3. An internal combustion engine control apparatus according to claim 2, wherein said correction means used the atmospheric pressure to correct said intake pipe pressure for a constant status, to correct the predicted value.

4. An internal combustion engine control apparatus according to claim 2, wherein said correction means uses the pressure on the side upstream of the throttle, to correct said intake pipe pressure for a constant status, and corrects the predicted value.

5. An internal combustion engine control apparatus according to claim 1 wherein said prediction means calculates an intake pipe pressure for a constant tate, on the basis of a current degree of throttle opening and a current engine speed, calculates a current value for the intake pipe pressure by processing said intake pipe pressure by a primary delay factor, and uses said current value to obtain the predicted.

6. An internal combustion engine control apparatus according to claim 1 wherein the value measured by said pressure measurement means is atmospheric pressure, for control of a naturally aspirating engine.

7. An internal combustion engine control apparatus as claimed in claim 1, wherein the value measured by said pressure measurement means is a boost pressure on a side upstream of the throttle, for control of an engine fitted with a supercharger.

8. An internal combustion engine control apparatus according to claim 1, wherein said correction means corrects the predicted value by accounting for the value meausred by said measurement means, in calculations of said prediction means.

* * * * *